US011833818B2

(12) United States Patent
Fukuzawa et al.

(10) Patent No.: US 11,833,818 B2
(45) Date of Patent: Dec. 5, 2023

(54) LIQUID EJECTING HEAD AND LIQUID EJECTING APPARATUS

(71) Applicant: SEIKO EPSON CORPORATION, Tokyo (JP)

(72) Inventors: Yuma Fukuzawa, Matsumoto (JP); Eiju Hirai, Azumino (JP); Yoichi Naganuma, Matsumoto (JP); Shotaro Tamai, Matsumoto (JP); Akinori Taniuchi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 65 days.

(21) Appl. No.: 17/233,900

(22) Filed: Apr. 19, 2021

(65) Prior Publication Data

US 2021/0323303 A1 Oct. 21, 2021

(30) Foreign Application Priority Data

Apr. 20, 2020 (JP) ..... 2020-074940

(51) Int. Cl.
*B41J 2/045* (2006.01)
*B41J 2/14* (2006.01)

(52) U.S. Cl.
CPC ..... *B41J 2/14233* (2013.01); *B41J 2/04581* (2013.01); *B41J 2002/14241* (2013.01); *B41J 2002/14338* (2013.01); *B41J 2202/12* (2013.01)

(58) Field of Classification Search
CPC ..... B41J 2002/14338
See application file for complete search history.

(56) References Cited

U.S. PATENT DOCUMENTS 4,024,544 A * 5/1977 Vernon ..... G01D 15/16 347/68
9,827,778 B2 * 11/2017 Ishikawa ..... B41J 2/18
11,077,660 B2 * 8/2021 Mizuno ..... B41J 2/14233
11,123,985 B2 * 9/2021 Mizuno ..... B41J 2/1433
2011/0316918 A1 * 12/2011 Nagashima ..... B41J 2/14233 347/12
2013/0233939 A1 9/2013 Uezawa
(Continued)

FOREIGN PATENT DOCUMENTS

JP 2009208445 A * 9/2009
JP 2013-184372 A 9/2013
(Continued)

*Primary Examiner* — Shelby L Fidler
(74) *Attorney, Agent, or Firm* — WORKMAN NYDEGGER

(57) ABSTRACT

A liquid ejecting head includes: a first pressure chamber that applies pressure to a liquid; a second pressure chamber that applies pressure to the liquid; a nozzle channel that extends in a first direction and includes a nozzle that ejects the liquid; a first communication channel that extends in a second direction crossing the first direction and enables the first pressure chamber and the nozzle channel to communicate with each other; a second communication channel that extends in the second direction and enables the second pressure chamber and the nozzle channel to communicate with each other; and a first branch channel that has a portion extending in the first direction and enables the first pressure chamber and the nozzle channel to communicate with each other through a path different from a path of the first communication channel.

17 Claims, 10 Drawing Sheets

(56) References Cited

U.S. PATENT DOCUMENTS

| | | | | |
|---|---|---|---|---|
| 2018/0086069 | A1* | 3/2018 | Kakiuchi | B41J 2/14233 |
| 2019/0329559 | A1 | 10/2019 | Ozawa | |
| 2020/0238698 | A1* | 7/2020 | Mizuno | B41J 2/14233 |
| 2020/0307212 | A1 | 10/2020 | Takabe et al. | |

FOREIGN PATENT DOCUMENTS

| | | | |
|---|---|---|---|
| JP | 2018-103418 | A | 7/2018 |
| JP | 2020-157610 | A | 10/2020 |

* cited by examiner

LIQUID EJECTING HEAD AND LIQUID EJECTING APPARATUS

The present application is based on, and claims priority from JP Application Serial Number 2020-074940, filed Apr. 20, 2020, the disclosure of which is hereby incorporated by reference herein in its entirety.

BACKGROUND

1. Technical Field

The present disclosure relates to a liquid ejecting head and a liquid ejecting apparatus.

2. Related Art

Liquid ejecting apparatuses such as ink jet printers generally have a liquid ejecting head that ejects liquid such as ink. For example, as disclosed in JP-A-2013-184372, a liquid ejecting head includes a pressure chamber that applies pressure to liquid, and a channel that communicates with the pressure chamber and that is provided with a nozzle that ejects liquid, and the pressure chamber and the channel communicate with each other. According to JP-A-2013-184372, a plurality of pressure chambers and a plurality of channels are arrayed in a given direction.

Depending on a shape of a channel extending from a pressure chamber to a nozzle, it may be difficult for the pressure to be transferred from the pressure chamber to the nozzle. For example, when the channel extending from the pressure chamber to the nozzle is elongated or is formed to be partially bent, it is difficult for the pressure to be transferred from the pressure chamber to the nozzle. In this case, increasing a sectional area of the channel extending from the pressure chamber to the nozzle to reduce channel resistance of the channel is considered for making it easy to transfer the pressure from the pressure chamber to the nozzle.

However, in a case in which the number of channels extending from the pressure chamber to the nozzle is one as described in JP-A-2013-184372, when the sectional area of the channel increases, a partition wall that separates adjacent channels tends to be warped. Therefore, when trying to efficiently transfer the pressure from the pressure chamber to the nozzle, there has been a problem that structural crosstalk caused by warping of the partition wall occurs.

Note that "structural crosstalk" refers to a phenomenon that, when vibration of one of two channels adjacent to each other is transferred to the other channel, ejection characteristics of ink from a nozzle provided in the other channel are deteriorated.

SUMMARY

To address the aforementioned problem, a liquid ejecting head according to a preferred aspect of the disclosure includes: a first pressure chamber that applies pressure to a liquid; a second pressure chamber that applies pressure to the liquid; a nozzle channel that extends in a first direction and includes a nozzle that ejects the liquid; a first communication channel that extends in a second direction crossing the first direction and enables the first pressure chamber and the nozzle channel to communicate with each other; a second communication channel that extends in the second direction and enables the second pressure chamber and the nozzle channel to communicate with each other; and a first branch channel that has a portion extending in the first direction and enables the first pressure chamber and the nozzle channel to communicate with each other through a path different from a path of the first communication channel.

A liquid ejecting apparatus according to a preferred aspect of the disclosure includes: the liquid ejecting head according to the aforementioned aspect; and a control section that controls liquid ejection operation of the liquid ejecting head.

DESCRIPTION OF EXEMPLARY EMBODIMENTS

Figure 1:
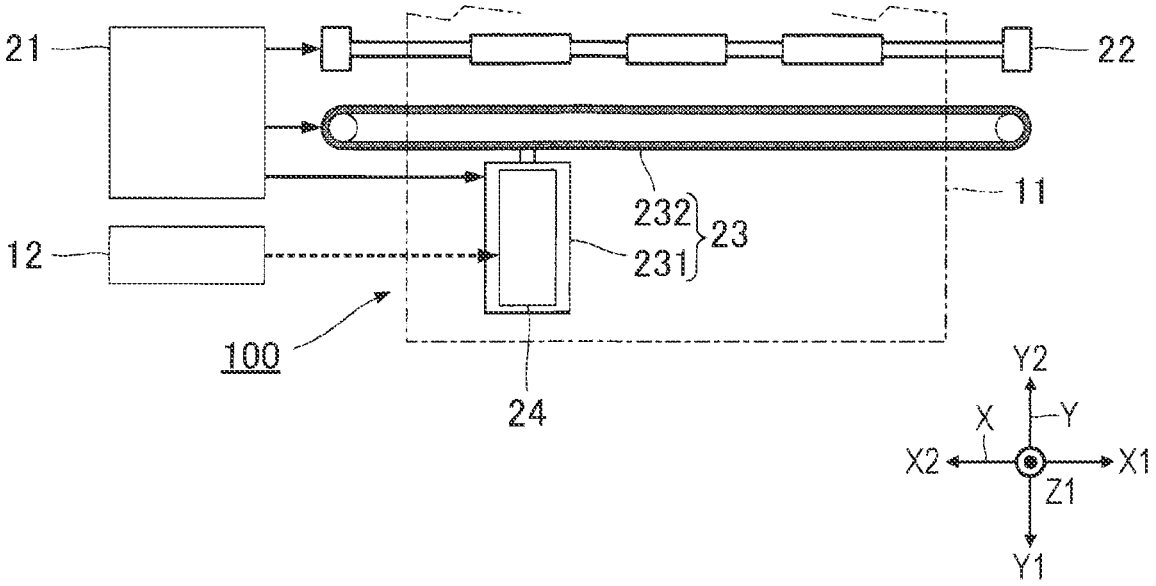
FIG. 1 is a schematic view illustrating an example of a configuration of a liquid ejecting apparatus according to a first embodiment.

Preferred embodiments of the disclosure will be described below with reference to the accompanying drawings. Note that, in the drawings, dimensions or scales of components appropriately differ from actual ones, and some components are schematically illustrated for easy understanding. The scope of the disclosure is not limited to the embodiments as long as there is no description particularly limiting the disclosure in the following description.

Note that the following description will be given by appropriately using the X-axis, the Y-axis, and the Z-axis that cross each other. The X-axis is an example of "a first axis". The Z-axis is an example of "a second axis". The Y-axis is an example of "a third axis". A direction extending along the X-axis is referred to as direction X1, and a direction opposite to direction X1 is referred to as direction X2. Similarly, directions opposite to each other along the Y-axis are referred to as direction Y1 and direction Y2. Directions opposite to each other along the Z-axis are referred to as direction Z1 and direction Z2. The direction extending along the X-axis is an example of "a first direction". The direction extending along the Z-axis is an example of "a second direction". The direction extending along the Y-axis is an example of "a third direction". Direction X1 is an example of "one side in the first direction". Direction X2 is an example of "another side in the first direction". Here, the Z-axis is typically an axis extending in the up-down direction, and direction Z2 corresponds to the down direction of the up-down direction. However, the Z-axis may be an axis that does not extend in the up-down direction. The X-axis, the Y-axis, and the Z-axis are typically orthogonal to each other but are not limited thereto. They may cross each other at an angle in a range of, for example, 80° to 100°.

A: First embodiment

A1: Overall Configuration of Liquid Ejecting Apparatus

FIG. 1 is a schematic view illustrating an example of a configuration of a liquid ejecting apparatus 100 according to a first embodiment. The liquid ejecting apparatus 100 is an ink jet printing apparatus that ejects droplets of liquid such as ink onto a medium 11. The medium 11 is, for example, a printing sheet. Note that the medium 11 is not limited to the printing sheet and may be, for example, a printing object made from any material such as a resin film or fabric.

A liquid container 12 is attached to the liquid ejecting apparatus 100. The liquid container 12 accumulates ink. Examples of a specific mode of the liquid container 12 include a cartridge detachably attachable to the liquid ejecting apparatus 100, a bag-like ink pack formed from a flexible film, or an ink tank that is able to be replenished with ink. Note that the liquid container 12 accumulates any type of ink.

As illustrated in FIG. 1, the liquid ejecting apparatus 100 includes a control unit 21, a transport mechanism 22, a moving mechanism 23, and a liquid ejecting head 24. The control unit 21 includes, for example, a processing circuit such as a CPU (central processing unit) or FPGA (field programmable gate array) and a storage circuit such as semiconductor memory and controls operation of the respective elements of the liquid ejecting apparatus 100. Here, the control unit 21 is an example of "a control section" and controls ink ejection operation of the liquid ejecting head 24.

The transport mechanism 22 transports the medium 11 in the Y-axis direction in accordance with control of the control unit 21. The moving mechanism 23 causes the liquid ejecting head 24 to be reciprocated in the X-axis direction in accordance with control of the control unit 21. The moving mechanism 23 includes a transport body 231 that is substantially box shaped and that houses the liquid ejecting head 24, and an endless transport belt 232 to which the transport body 231 is fixed. Note that the number of liquid ejecting heads 24 mounted on the transport body 231 is not limited to one and may be two or more. Moreover, the liquid container 12 described above may be mounted on the transport body 231 together with the liquid ejecting head 24.

The liquid ejecting head 24 ejects the ink, which is supplied from the liquid container 12, from a plurality of nozzles onto the medium 11 in accordance with control of the control unit 21. The ejection is performed in conjunction with transport of the medium 11 by the transport mechanism 22 and reciprocation of the liquid ejecting head 24 by the transport body 23, and thereby, an image is formed on the surface of the medium 11.

A2: Channels of Liquid Ejecting Head

Figure 2:
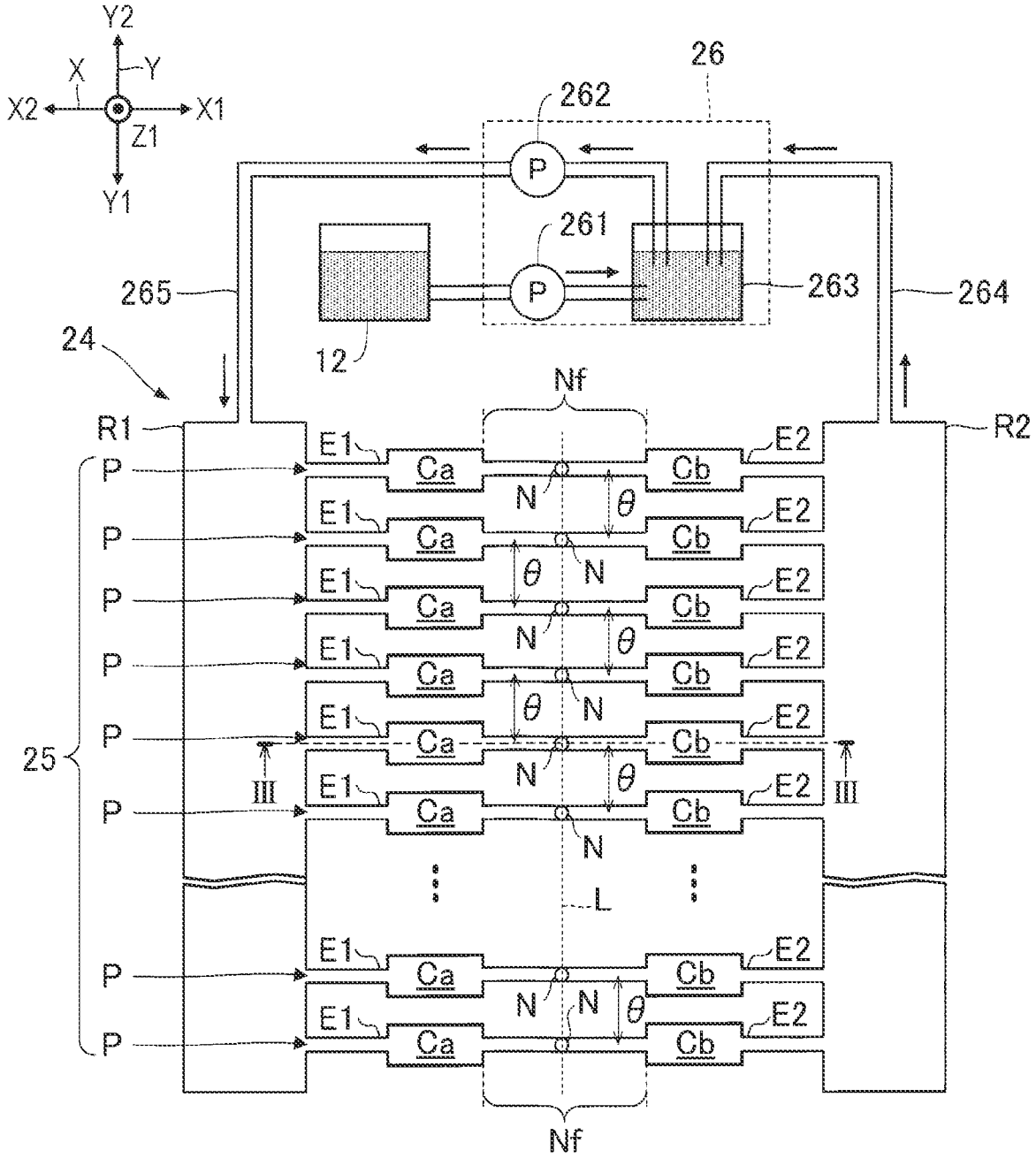
FIG. 2 is a schematic view of channels of a liquid ejecting head according to the first embodiment.

FIG. 2 is a schematic view of channels of the liquid ejecting head 24 according to the first embodiment. As illustrated in FIG. 2, the liquid ejecting head 24 includes a plurality of nozzles N, a plurality of individual channels P, a first common liquid chamber R1, and a second common liquid chamber R2 and is coupled to a circulation mechanism 26.

Specifically, the liquid ejecting head 24 has a surface facing the medium 11, and the plurality of nozzles N are provided on the surface as illustrated in FIG. 2. The plurality of nozzles N are arrayed in the Y-axis direction. The plurality of nozzles N eject the ink in direction Z2.

Here, a set of the plurality of nozzles N constitutes a nozzle row L. The plurality of nozzles N are arrayed at an equal pitch θ. The pitch θ is a distance between the centers of the plurality of nozzles N in the Y-axis direction.

The individual channels P communicate with the plurality of nozzles N. The plurality of individual channels P extend in the X-axis direction and communicate with the nozzles N that differ from each other. A set of the plurality of individual channels P constitutes an individual channel row 25. The plurality of individual channels P are arrayed in the Y-axis direction.

As illustrated in FIG. 2, each of the individual channels P includes a pressure chamber Ca, a pressure chamber Cb, and a nozzle channel Nf. Here, the pressure chamber Ca is an example of a first pressure chamber. The pressure chamber Cb is an example of a second pressure chamber. Each of the pressure chamber Ca and the pressure chamber Cb of the individual channel P extends in the X-axis direction and is a void that accumulates the ink to be ejected from a nozzle N communicating with the individual channel P. In the example illustrated in FIG. 2, a plurality of pressure chambers Ca are arrayed in the Y-axis direction. Similarly, a plurality of pressure chambers Cb are arrayed in the Y-axis direction. Note that, in each of the individual channels P, the position of each of the pressure chambers Ca in the Y-axis direction and the position of each of the pressure chambers Cb in the Y-axis direction are the same in the example illustrated in FIG. 2 but may differ from each other. In the following description, when there is no particular necessity to distinguish between the pressure chamber Ca and the pressure chamber Cb, they are simply referred to also as "pressure chambers C".

The nozzle channel Nf is arranged between the pressure chamber Ca and the pressure chamber Cb of the individual channel P. In the individual channel P, the nozzle channel Nf extends in the X-axis direction and constitutes at least a portion of a channel that enables the pressure chamber Ca and the pressure chamber Cb to communicate with each other. A plurality of nozzle channels Nf are arrayed with a gap therebetween in the Y-axis direction. Each of the nozzle channels Nf is provided with the nozzle N. When pressure in the pressure chamber Ca or the pressure chamber Cb described above changes, the ink is ejected from the nozzle N of the nozzle channel Nf.

The plurality of individual channels P enable the first common liquid chamber R1 and the second common liquid chamber R2 to communicate with each other. Each of the first common liquid chamber R1 and the second common liquid chamber R2 is a void that extends in the Y-axis direction over an entire region in which the plurality of nozzles N are distributed. The aforementioned individual channel row 25 and the plurality of nozzles N are positioned between the first common liquid chamber R1 and the second common liquid chamber R2 as viewed in the Z-axis direction. In other words, the individual channel row 25 and the plurality of nozzles N are positioned between the first common liquid chamber R1 and the second common liquid chamber R2 in the X-axis direction. Note that, in the following description, viewing in the Z-axis direction is also referred to as "plan view".

Here, the first common liquid chamber R1 is coupled to an end E1 of each of the individual channels P in direction X2. The first common liquid chamber R1 accumulates the ink to be supplied to each of the individual channels P. On the other hand, the second common liquid chamber R2 is coupled to an end E2 of each of the individual channels P in direction X1. The second common liquid chamber R2 accumulates the ink to be discharged from each of the individual channels P without being ejected.

The circulation mechanism 26 is coupled to the first common liquid chamber R1 and the second common liquid chamber R2. The circulation mechanism 26 is a mechanism that causes the ink to be supplied to the first common liquid chamber R1 and collects the ink, which is discharged from the second common liquid chamber R2, to supply the ink again to the first common liquid chamber R1. The circulation mechanism 26 includes a first supply pump 261, a second supply pump 262, an accumulation container 263, a collection channel 264, and a supply channel 265.

The first supply pump 261 is a pump that supplies the ink accumulated in the liquid container 12 to the accumulation container 263. The accumulation container 263 is a temporary storage tank that temporarily stores the ink supplied from the liquid container 12. The collection channel 264 is a channel that enables the second common liquid chamber R2 and the accumulation container 263 to communicate with each other and that collects, in the accumulation container 263, the ink from the second common liquid chamber R2. The ink accumulated in the liquid container 12 is supplied from the first supply pump 261 to the accumulation container 263, and the ink discharged from the respective individual channels P to the second common liquid chamber R2 is additionally supplied to the accumulation container 263 via the collection channel 264. The second supply pump 262 is a pump that discharges the ink accumulated in the accumulation container 263. The supply channel 265 is a channel which enables the first common liquid chamber R1 and the accumulation container 263 to communicate with each other and through which the ink from the accumulation container 263 is supplied to the first common liquid chamber R1.

A3: Specific Structure of Liquid Ejecting Head

Figure 3:
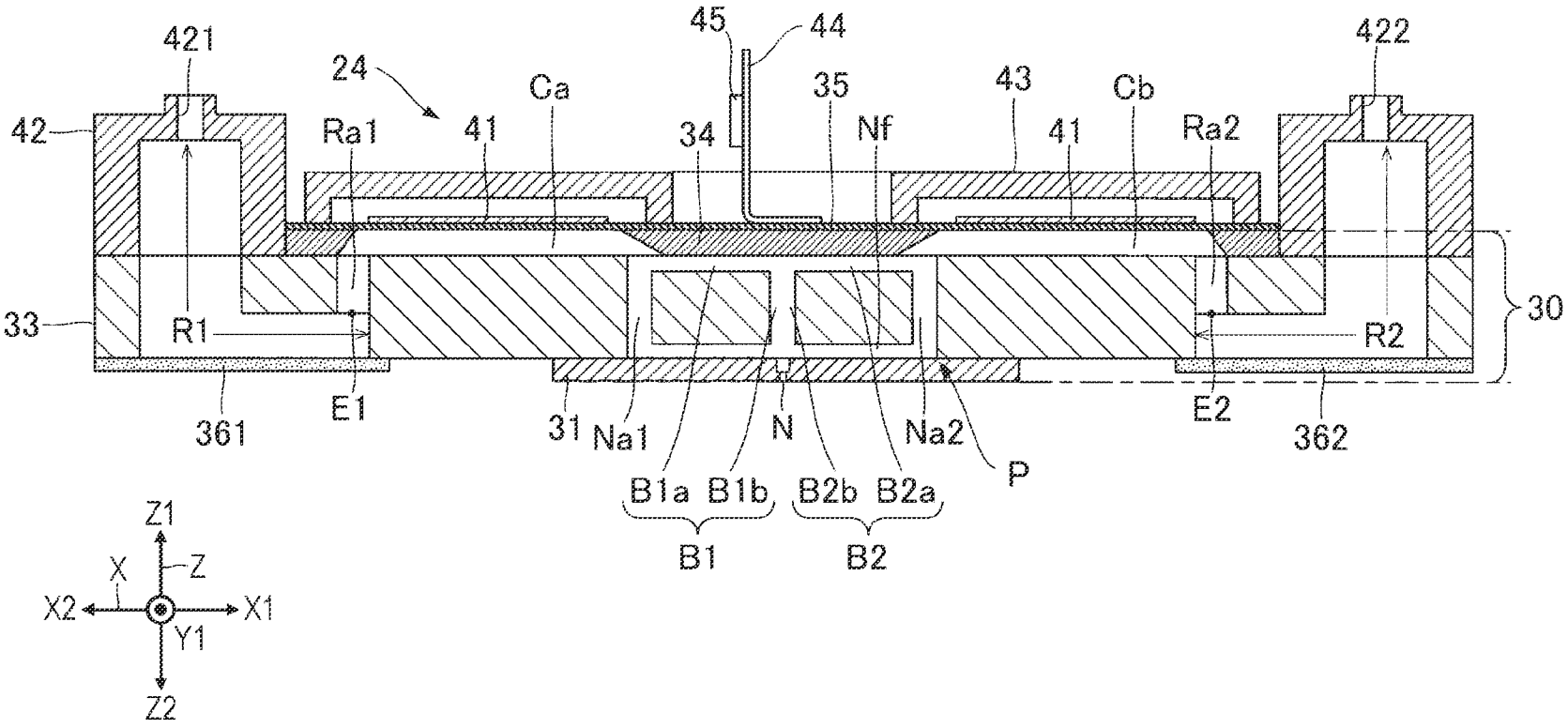
FIG. 3 is a sectional view along line III-III in FIG. 2.

FIG. 3 is a sectional view along line III-III in FIG. 2. FIG. 3 illustrates a sectional surface of the liquid ejecting head 24, which is taken along a plane parallel to the X-axis and the Z-axis of the individual channel P. As illustrated in FIG. 3, the liquid ejecting head 24 includes a channel structure 30, a plurality of piezoelectric elements 41, a housing 42, a protection substrate 43, and a wiring substrate 44.

In the channel structure 30, the first common liquid chamber R1, the second common liquid chamber R2, the plurality of individual channels P, and the plurality of nozzles N described above are provided. Specifically, the channel structure 30 is a structure in which a nozzle substrate 31, a communication plate 33, a pressure chamber substrate 34, and a vibrating plate 35 are layered in this order in direction Z1. Members of the nozzle substrate 31, the communication plate 33, the pressure chamber substrate 34, and the vibrating plate 35 extend in the Y-axis direction and are each manufactured such that, for example, a silicon monocrystalline substrate is processed by using a semiconductor processing technique. The members are bonded to each other with an adhesive or the like. Note that another layer or substrate such as an adhesive layer may be appropriately interposed between two adjacent members among the plurality of members that constitute the channel structure 30.

The plurality of nozzles N are provided in the nozzle substrate 31. The plurality of nozzles N are through holes that penetrate through the nozzle substrate 31 and that enable the ink to pass therethrough.

In the communication plate 33, a portion of the first common liquid chamber R1, a portion of the second common liquid chamber R2, and a portion other than the pressure chamber Ca and the pressure chamber Cb in each of the plurality of individual channels P are provided. Here, the individual channels P each include a first communication channel Na1, a second communication channel Na2, a first branch channel B1, and a second branch channel B2, a supply channel Ra1, and a discharge channel Ra2 in addition to the pressure chamber Ca, the pressure chamber Cb, and the nozzle channel Nf described above. Among these, the nozzle channel Nf, the first communication channel Na1, the second communication channel Na2, the first branch channel B1, and the second branch channel B2, the supply channel Ra1, and the discharge channel Ra2 are provided in the communication plate 33.

The portion of the first common liquid chamber R1 and the portion of the second common liquid chamber R2 are voids penetrating through the communication plate 33. On the surface facing direction Z2 of the communication plate 33, a vibration absorber 361 and a vibration absorber 362 that close openings formed by the voids are disposed.

The vibration absorber 361 and the vibration absorber 362 are layer members formed of an elastic material. The vibration absorber 361 constitutes a portion of a wall surface of the first common liquid chamber R1 and absorbs a change in the pressure in the first common liquid chamber R1. Similarly, the vibration absorber 362 constitutes a portion of a wall surface of the second common liquid chamber R2 and absorbs a change in the pressure in the second common liquid chamber R2.

The nozzle channel Nf is a space in a groove provided on the surface facing direction Z2 of the communication plate 33. Here, the nozzle substrate 31 constitutes a portion of a wall surface of the nozzle channel Nf.

The first communication channel Na1 and the second communication channel Na2 extend in the Z-axis direction and are spaces penetrating through the communication plate 33. The first communication channel Na1 enables the pressure chamber Ca and the nozzle channel Nf to communicate with each other and guides the ink from the pressure chamber Ca to the nozzle channel Nf. On the other hand, the second communication channel Na2 enables the pressure chamber Cb and the nozzle channel Nf to communicate with each other and guides the ink from the nozzle channel Nf to the pressure chamber Cb.

Each of the first branch channel B1 and the second branch channel B2 is a space formed by a groove provided on the surface facing direction Z1 of the communication plate 33 and a hole penetrating through the communication plate 33 in the Z-axis direction. The first branch channel B1 enables the pressure chamber Ca and the nozzle channel Nf to communicate with each other through a path different from a path of the first communication channel Na1. The first branch channel B1 of the present embodiment has a first channel B1*a* extending in in the X-axis direction and a second channel B1*b* extending in the Z-axis direction. On the other hand, the second branch channel B2 enables the pressure chamber Cb and the nozzle channel Nf to communicate with each other through a path different from a path of the second communication channel Na2. The second branch channel B2 of the present embodiment has a third channel B2*a* extending in the X-axis direction and a fourth channel B2*b* extending in the Z-axis direction. Note that the first branch channel B1 and the second branch channel B2 will be described later in detail.

The supply channel Ra1 and the discharge channel Ra2 are spaces that extend in the Z-axis direction and that penetrate through the communication plate 33. The supply channel Ra1 enables the first common liquid chamber R1 and the pressure chamber Ca to communicate with each other and is used to supply the ink from the first common liquid chamber R1 to the pressure chamber Ca. Here, one end of the supply channel Ra1 is opened to the surface facing direction Z1 of the communication plate 33. Meanwhile, the other end of the supply channel Ra1 is the end E1 on the upstream of the individual channel P and is opened to a wall surface of the first common liquid chamber R1 in the communication plate 33. On the other hand, the discharge channel Ra2 enables the second common liquid chamber R2 and the pressure chamber Cb to communicate with each other and is used to discharge the ink from the pressure chamber Cb to the second common liquid chamber R2. Here, one end of the discharge channel Ra2 is opened to the surface facing direction Z1 of the communication plate 33. Meanwhile, the other end of the discharge channel Ra2 is the end E2 on the downstream of the individual channel P and is opened to a wall surface of the second common liquid chamber R2 in the communication plate 33.

The pressure chambers Ca and the pressure chambers Cb of the plurality of individual channels P are provided in the pressure chamber substrate 34. The pressure chambers Ca and the pressure chambers Cb are voids that penetrate through the pressure chamber substrate 34 and that are provided between the communication plate 33 and the vibrating plate 35.

The vibrating plate 35 is a plate member capable of elastically vibrating. The vibrating plate 35 is, for example, a layered body that includes a first layer made of silicon oxide ($SiO_2$) and a second layer made of zirconium oxide ($ZrO_2$). Here, another layer made of metal oxide or the like may be interposed between the first layer and the second layer. Note that a portion or entirety of the vibrating plate 35 may be formed to be integrated with the pressure chamber substrate 34 by the same material. For example, the vibrating plate 35 and the pressure chamber substrate 34 are able to be integrally formed by a plate member of a given thickness, from which some region corresponding to a pressure chamber C in the thickness direction is selectively removed. Moreover, the vibrating plate 35 may be formed by a single material layer.

The plurality of piezoelectric elements 41 corresponding to different pressure chambers C are disposed on the surface facing direction Z1 of the vibrating plate 35. Here, a piezoelectric element 41 corresponding to each of the pressure chambers Ca is an example of a first energy-generating element. A piezoelectric element 41 corresponding to each of the pressure chambers Cb is an example of a second energy-generating element. The piezoelectric elements 41 corresponding to the respective pressure chambers C overlap the pressure chambers C in plan view. Each of the piezoelectric elements 41 is constituted, for example, by stacking a first electrode and a second electrode that face each other with a piezoelectric layer disposed between both the electrodes. Each of the piezoelectric elements 41 changes the pressure of the ink in the pressure chamber C to thereby eject the ink in the pressure chamber C from the nozzle N. Upon supply of a driving voltage, the piezoelectric element 41 causes the piezoelectric element 41 to deform and thereby causes the vibrating plate 35 to vibrate. When the pressure chamber C expands and contracts upon the vibration, the pressure of the ink in the pressure chamber C changes.

The housing 42 is a case for accumulating the ink. In the housing 42, a space that constitutes a remaining portion of the first common liquid chamber R1 other than a region provided in the communication plate 33 and a space that constitutes a remaining portion of the second common liquid chamber R2 other than a region provided in the communication plate 33 are provided. A supply port 421 and a discharge port 422 are provided in the housing 42. The supply port 421 is a pipeline, which communicates with the first common liquid chamber R1, and is coupled to the supply channel 265 of the circulation mechanism 26. Therefore, the ink discharged from the second supply pump 262 to the supply channel 265 is supplied to the first common liquid chamber R1 via the supply port 421. On the other hand, the discharge port 422 is a pipeline, which communicates with the second common liquid chamber R2, and is coupled to the collection channel 264 of the circulation mechanism 26. Therefore, the ink in the second common liquid chamber R2 is discharged to the collection channel 264 via the discharge port 422.

The protection substrate 43 is a plate member disposed on the surface facing direction Z1 of the vibrating plate 35, protects the plurality of piezoelectric elements 41, and reinforces the mechanical strength of the vibrating plate 35. Here, the plurality of piezoelectric elements 41 are housed between the protection substrate 43 and the vibrating plate 35.

The wiring substrate 44 is mounted on the surface facing direction Z1 of the vibrating plate 35 and is a mounting component for electrically coupling the control unit 21 and the liquid ejecting head 24. For example, a flexible wiring substrate 44, such as an FPC (flexible printed circuit) or FFC (flexible flat cable), is preferably used. A drive circuit 45 for supplying a driving voltage to each of the piezoelectric elements 41 is mounted on the wiring substrate 44.

In the liquid ejecting head 24 configured as described above, upon the operation of the circulation mechanism 26 described above, the ink flows in the first common liquid chamber R1, the supply channel Ra1, the pressure chamber Ca, the first communication channel Na1, the nozzle channel Nf, the second communication channel Na2, the pressure chamber Cb, the discharge channel Ra2, and the second common liquid chamber R2 in this order. Here, a portion of the ink flowing from the pressure chamber Ca to the pressure chamber Cb passes through the first communication channel Na1, the nozzle channel Nf, and the second communication channel Na2 in this order and the rest of the ink appropriately passes through at least one of the first branch channel B1 and the second branch channel B2. In the example illustrated in FIG. 3, a portion of the ink flowing from the pressure chamber Ca to the pressure chamber Cb may pass through the first branch channel B1 and the second branch channel B2 without passing through the nozzle channel Nf.

When piezoelectric elements 41 corresponding to both the pressure chamber Ca and the pressure chamber Cb are driven at the same time upon application of a driving voltage from the drive circuit 45, the pressure of the pressure chamber Ca and the pressure chamber Cb changes, and the ink is ejected from the nozzle N in response to the change in pressure. Note that any operation period or any operation timing may be set as an operation period or an operation timing of the circulation mechanism 26, and the operation period or the operation timing may be freely set so as to overlap a period or a timing of ejection of the ink from the nozzle N.

By causing the ink used for the liquid ejecting head 24 to circulate as described above, it is possible to suppress an increase in viscosity and precipitation of components of the ink near the nozzle N. Therefore, it is possible to prevent a deterioration in ejection characteristics such as the ejection amount or ejection velocity of the ink in the liquid ejecting head 24. As a result, it is possible to achieve stable ejection characteristics of the ink in the liquid ejecting head 24 for a long time period.

A4: Details of First Branch Channel and Second Branch Channel

Figure 4:
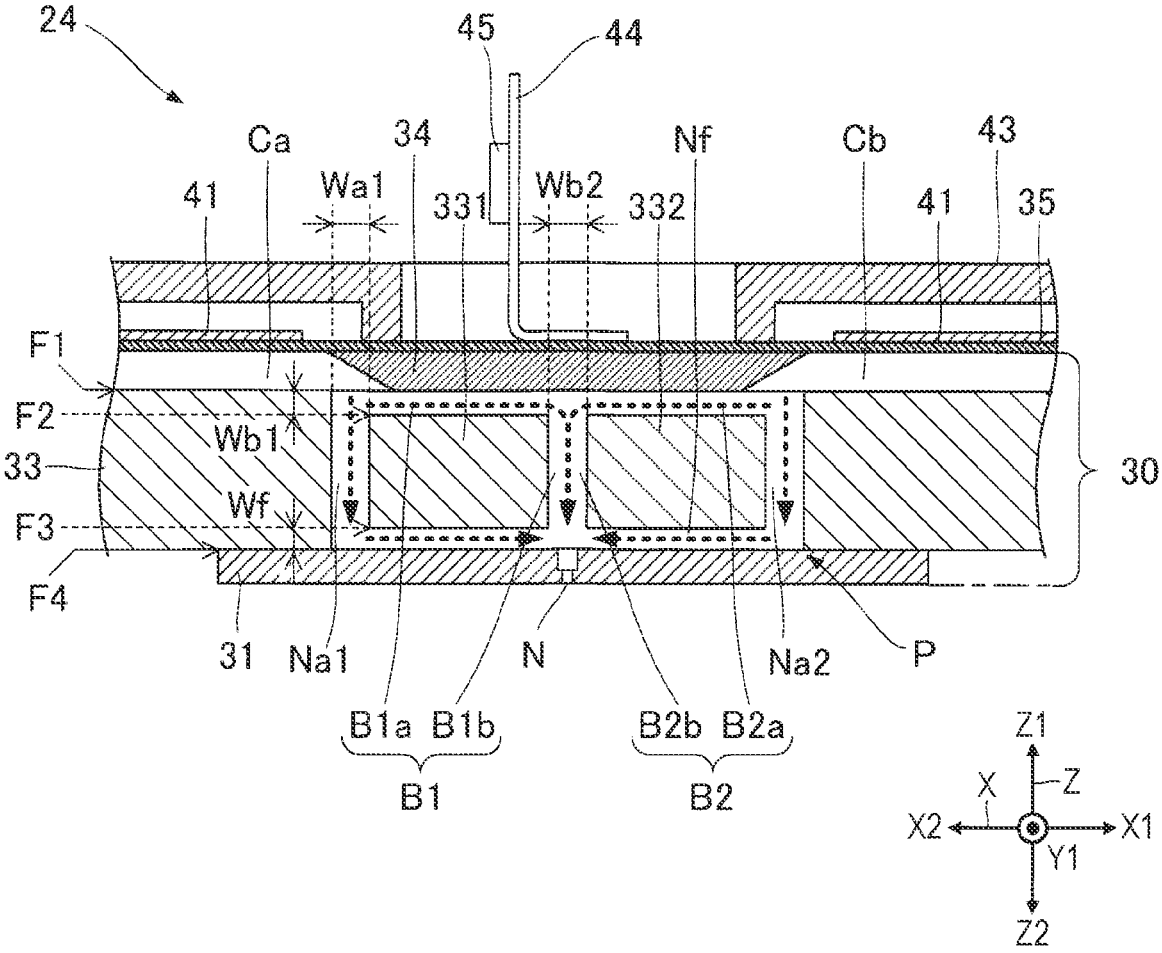
FIG. 4 is an enlarged sectional view illustrating a portion of the liquid ejecting head illustrated in FIG. 3.

FIG. 4 is an enlarged sectional view illustrating a portion of the liquid ejecting head 24 illustrated in FIG. 3. In FIG. 4, an ink flow path from each of the pressure chamber Ca and the pressure chamber Cb to the nozzle N is indicated by the thick broken line.

As described above, the nozzle channel Nf is the space in the groove provided on the surface facing direction Z2 of the communication plate 33. Here, wall surfaces of the nozzle channel Nf include a wall surface F3 formed by the surface facing direction Z2 of the communication plate 33 and a wall surface F4 formed by the surface facing direction Z1 of the nozzle substrate 31. The wall surface F3 is an example of a third wall surface. The wall surface F4 is an example of a fourth wall surface.

The nozzle channel Nf extends in the X-axis direction, and the nozzle N is provided in the middle of the nozzle channel Nf. In the example illustrated in FIG. 4, the nozzle N is provided in the center of the nozzle channel Nf in the X-axis direction. The pressure chamber Ca communicates with an end of the nozzle channel Nf in direction X2 via the first communication channel Na1. Therefore, the pressure of the pressure chamber Ca is transferred to the nozzle N via the first communication channel Na1 and the nozzle channel Nf. On the other hand, the pressure chamber Cb communicates with an end of the nozzle channel Nf in direction X1 via the second communication channel Na2. Therefore, the pressure of the pressure chamber Cb is transferred to the nozzle N via the second communication channel Na2 and the nozzle channel Nf.

Here, since the nozzle N is not positioned directly below the pressure chamber Ca but is provided in the middle of the nozzle channel Nf, channel resistance of a channel extending from the pressure chamber Ca to the nozzle N via the first communication channel Na1 tends to be high.

Specifically, as described above, while the first communication channel Na1 extends in the Z-axis direction, the nozzle channel Nf extends in the X-axis direction. Therefore, the first communication channel Na1 and the nozzle channel Nf are orthogonal to each other. Accordingly, in the channel extending from the pressure chamber Ca to the nozzle N via the first communication channel Na1, a pressure loss caused by friction between the ink and a wall surface increases in accordance with a dimension of the channel. Further, a pressure loss due to a vortex of the ink in a portion where the first communication channel Na1 and the nozzle channel Nf are coupled may be caused in some cases. As a result, channel resistance of the channel tends to be high.

By increasing sectional areas of the first communication channel Na1 and the nozzle channel Nf, the channel resistance of the channel extending from the pressure chamber Ca to the nozzle N via the first communication channel Na1 is able to be reduced. However, this makes a partition wall, which separates two first communication channels Na1 adjacent to each other in the Y-axis direction, readily warped, and structural crosstalk may be caused by warping of the partition wall.

Thus, the liquid ejecting head 24 includes, as the channel extending from the pressure chamber Ca to the nozzle channel Nf, the first branch channel B1 in addition to the first communication channel Na1. For a similar reason, the liquid ejecting head 24 includes, as a channel extending from the pressure chamber Cb to the nozzle channel Nf, the second branch channel B2 in addition to the second communication channel Na2.

A partition wall 331 separates the first branch channel B1 and the first communication channel Na1, and the first branch channel B1 is a channel different from the first communication channel Na1. As described above, the first branch channel B1 has the first channel B1*a* extending in the X-axis direction and the second channel B1*b* extending in the Z-axis direction. Similarly, a partition wall 332 separates the second branch channel B2 and the second communication channel Na2, and the second branch channel B2 is a channel different from the second communication channel Na2. As described above, the second branch channel B2 has the third channel B2*a* extending in the X-axis direction and the fourth channel B2*b* extending in the Z-axis direction.

Here, the first branch channel B1 and the second branch channel B2 are similar in the configuration except that they are configured symmetrically in the X-axis direction. Thus, the first channel B1*a* and the third channel B2*a* are configured symmetrically in the X-axis direction. Moreover, the second channel B1*b* and the fourth channel B2*b* are configured symmetrically in the X-axis direction.

The first branch channel B1 will be representatively described below, and description for the second branch channel B2 will be omitted as appropriate. Note that the first branch channel B1 and the second branch channel B2 may be configured asymmetrically in the X-axis direction. Note that, when the first branch channel B1 and the second branch channel B2 are configured symmetrically in the X-axis direction, there is an advantage that the liquid ejecting head 24 is easily designed.

The first channel B1*a* is a space formed by a groove provided on the surface facing direction Z1 of the communication plate 33. Here, wall surfaces of the first channel B1*a* include a wall surface F1 formed by the surface facing direction Z2 of the pressure chamber substrate 34 and a wall surface F2 formed by the surface facing direction Z1 of the communication plate 33. The wall surface F1 is an example of a first wall surface. The wall surface F2 is an example of a second wall surface. An end of the aforementioned first channel B1*a* in direction X2 communicates with the pressure chamber Ca. On the other hand, an end of the first channel B1*a* in direction X1 communicates with the second channel B1*b*.

The second channel B1*b* is a space formed by a hole penetrating through the communication plate 33 in the Z-axis direction. An end of the second channel B1*b* in direction Z1 communicates with the first channel B1*a*. On the other hand, an end of the second channel B1*b* in direction Z2 communicates with the nozzle channel Nf. Here, the second channel B1*b* is positioned so as to overlap the nozzle N as viewed in the Z-axis direction. Therefore, the pressure of the second channel B1*b* is able to be directly transferred to the nozzle N.

In the present embodiment, the second channel B1*b* is shared with the fourth channel B2*b* of the second branch channel B2. That is, the second channel B1*b* and the fourth channel B2*b* constitute one channel extending in the Z-axis direction. Thus, both the second channel B1*b* and the fourth channel B2*b* are able to be arranged at a position where they overlap the nozzle N as viewed in the Z-axis direction.

Moreover, in the present embodiment, a dimension of a channel extending from the pressure chamber Ca to the nozzle N via the first branch channel B1 is substantially equal to a dimension of the channel extending from the pressure chamber Ca to the nozzle N via the first communication channel Na1.

In the first branch channel B1 described above, channel resistance of the channel extending from the pressure chamber Ca to the nozzle N via the first branch channel B1 is desired to be approximately the same as channel resistance of the channel extending from the pressure chamber Ca to the nozzle N via the first communication channel Na1 to transfer the pressure of the pressure chamber Ca via both the first communication channel Nal and the first branch channel B1 as efficiently as possible.

From the foregoing viewpoint, the sectional area of the first channel B1*a* is desirably equal to the sectional area of the nozzle channel Nf. Thus, when the first channel B1*a* width in the Y-axis direction and the nozzle channel Nf width in the Y-axis direction are equal to each other, width Wb1 of the first channel B1*a* in the Z-axis direction and width Wf of the nozzle channel Nf in the Z-axis direction are desirably equal to each other.

Moreover, in the present embodiment, since the second channel B1*b* is shared with the fourth channel B2*b* of the second branch channel B2 as described above, the sectional area of the second channel B1*b* is desirably larger than the sectional area of the first communication channel Na1 such that channel resistance of the second channel B1*b* and channel resistance of the first communication channel Na1 are equal to each other. Thus, when the second channel B1*b* width in the Y-axis direction and the first communication channel Na1 width in the Y-axis direction are equal to each other, width Wb2 of the second channel B1*b* in the X-axis direction is desirably wider than width Wal of the first communication channel Na1 in the X-axis direction. Note that the second channel B1*b* width in the Y-axis direction and the first communication channel Na1 width in the Y-axis direction may differ from each other such that the channel resistance of the second channel B1*b* and the channel resistance of the first communication channel Nal are equal to each other.

The liquid ejecting head 24 described above includes the pressure chamber Ca as an example of the first pressure chamber, the pressure chamber Cb as an example of the second pressure chamber, the nozzle channel Nf, the first communication channel Na1, the second communication channel Na2, and the first branch channel B1 as described above.

The pressure chamber Ca and the pressure chamber Cb each apply pressure to the ink that is an example of a liquid. The nozzle channel Nf extends in the X-axis direction as an example of the first axis and is provided with the nozzle N that ejects the ink. The first communication channel Na1 extends in the Z-axis direction as an example of the second axis crossing the first axis and enables the pressure chamber Ca and the nozzle channel Nf to communicate with each other. The second communication channel Nat extends in the Z-axis direction and enables the pressure chamber Cb and the nozzle channel Nf to communicate with each other. The first branch channel B1 has a portion extending in the X-axis direction and enables the pressure chamber Ca and the nozzle channel Nf to communicate with each other through a path different from a path of the first communication channel Na1.

In the liquid ejecting head 24 described above, since each of the first communication channel Na1 and the first branch channel B1 enables the pressure chamber Ca and the nozzle channel Nf to communicate with each other, it is possible to reduce the channel resistance of the channel extending from the pressure chamber Ca to the nozzle channel Nf compared with the configuration in which no first branch channel B1 is provided. As a result, it is possible to efficiently transfer the pressure from the pressure chamber Ca to the nozzle N compared with the configuration in which no first branch channel B1 is provided.

Here, since the first branch channel B1 is a path different from the first communication channel Na1, even when the channel resistance of the channel extending from the pressure chamber Ca to the nozzle channel Nf is reduced, the sectional area of each of the channels is able to be reduced compared with the configuration in which no first branch channel B1 is provided. Thus, even when a plurality of channels described above are arrayed in the Y-axis direction, it is possible to suppress warping of a partition wall that separates the channels. As a result, it is possible to reduce structural crosstalk caused by warping of the partition wall between the channels.

Since the first branch channel B1 has the portion extending in the X-axis direction, it is possible to increase the aforementioned partition wall in thickness compared with the configuration in which the first branch channel B1 does not have the portion. In addition, in the configuration in which the first branch channel B1 has the portion, even when the nozzle N is provided in the middle of the nozzle channel Nf extending in the X-axis direction, a communication position of the first branch channel B1 and the nozzle channel Nf is readily close to the nozzle N compared with the configuration in which the first branch channel B1 does not have the portion. Therefore, when the communication position becomes close to the nozzle N, it is possible to efficiently transfer the pressure from the pressure chamber Ca to the nozzle N via the first branch channel B1.

In the present embodiment, as described above, the first branch channel B1 has the first channel B1*a* and the second channel B1*b*. The first channel B1*a* extends in the X-axis direction and communicates with the pressure chamber Ca. On the other hand, the second channel B1*b* extends in the Z-axis direction and enables the first channel B1*a* and the nozzle channel Nf to communicate with each other. Such a first branch channel B1 having the first channel B1*a* and the second channel B1*b* enables the pressure chamber Ca and the nozzle channel Nf to communicate with each other and enables the partition wall 331 to be increased in thickness in the X-axis direction in accordance with a dimension of the first channel B1*a*.

As described above, the pressure chamber Ca and the nozzle channel Nf each extend in the X-axis direction. Here, the first communication channel Na1 enables an end of the pressure chamber Ca in direction X1 that is one direction extending in the X-axis direction and an end of the nozzle channel Nf in direction X2 that is the other direction extending in the X-axis direction to communicate with each other. Therefore, it is possible to efficiently transfer the pressure from the pressure chamber Ca to the nozzle N via the first communication channel Na1 compared with the configuration in which the first communication channel Na1 communicates with an intermediate portion of the pressure chamber Ca or communicates with an intermediate portion of the nozzle channel Nf in the X-axis direction.

As described above, the first branch channel B1 communicates with the nozzle channel Nf at a position closer than the first communication channel Na1 to the nozzle N. Therefore, it is possible to efficiently transfer the pressure from the pressure chamber Ca to the nozzle N via the first branch channel B1 compared with the configuration in which the first branch channel B1 communicates with the nozzle channel Nf at a position farther than the first communication channel Na1 from the nozzle N.

In the liquid ejecting head 24, as described above, the channels regarding the pressure chamber Cb are configured similarly to the channels regarding the pressure chamber Ca. That is, the liquid ejecting head 24 further includes the second branch channel B2. The second branch channel B2 has a portion extending in the X-axis direction and enables the pressure chamber Cb and the nozzle channel Nf to communicate with each other through a path different from a path of the second communication channel Na2.

Therefore, similarly to the aforementioned channel extending from the pressure chamber Ca to the nozzle channel Nf, it is possible to reduce channel resistance of a channel extending from the pressure chamber Cb to the nozzle Nf and suppress warping of a partition wall that separates channels compared with the configuration in which no second branch channel B2 is provided. In addition, similarly to the pressure being transferred from the pressure chamber Ca to the nozzle N as described above, it is possible to efficiently transfer the pressure from the pressure chamber Cb to the nozzle N via the second branch channel B2.

Here, similarly to the first channel B1*a* and the second channel B1*b* of the first branch channel B1, the second branch channel B2 has the third channel B2*a* and the fourth channel B2*b* as described above. In the present embodiment, the second channel B1*b* and the fourth channel B2*b* are shared. That is, the first branch channel B1 and the second branch channel B2 respectively have the second channel B1*b* and the fourth channel B2*b* as a shared portion extending in the Z-axis direction. Therefore, a communication position of the first branch channel B1 and the nozzle channel Nf is able to match a communication position of the second branch channel B2 and the nozzle channel Nf. As a result, both the communication positions are able to be close to the nozzle N.

As described above, the liquid ejecting head 24 further includes the pressure chamber substrate 34, the communication plate 33, and the nozzle substrate 31. The pressure chamber substrate 34 is provided with the pressure chamber Ca and the pressure chamber Cb. The communication plate 33 is provided with the nozzle channel Nf, the first communication channel Na1, the second communication channel Na2, and the first branch channel B1. The nozzle substrate 31 is provided with the nozzle N. In the liquid ejecting head 24 constituted by using such a plurality of substrates, by processing and bonding the plurality of substrates, the respective channels and the respective pressure chambers C that are excellent in dimensional accuracy are able to be formed with good yield.

Here, wall surfaces of the first branch channel B1 include the wall surface F1 as an example of the first wall surface and the wall surface F2 as an example of the second wall surface. The wall surface F1 is constituted by the pressure chamber substrate 34. The wall surface F2 is positioned opposite to the wall surface F1 in the Z-axis direction and is constituted by the communication plate 33. In this manner, by constituting the wall surfaces of the first branch channel B1 by using the communication plate 33 and the pressure chamber substrate 34, a portion extending in the X-axis direction is able to be easily formed in the first branch channel B1 by using, for example, a groove formed on the wall surface F1 or the wall surface F2.

The nozzle channel Nf has the wall surface F3 as an example of the third wall surface and the wall surface F4 as an example of the fourth wall surface. The wall surface F3 is constituted by the communication plate 33. The wall surface F4 is positioned opposite to the wall surface F3 in the Z-axis direction and is constituted by the nozzle substrate 31. In this manner, by constituting the wall surfaces of the nozzle channel Nf by using the nozzle substrate 31 and the communication plate 33, the nozzle channel Nf extending in the X-axis direction is able to be easily formed by using, for example, a groove formed on the wall surface F3 or the wall surface F4.

As described above, the liquid ejecting head 24 further includes the supply channel Ra1 and the discharge channel Ra2. The supply channel Ra1 communicates with the pressure chamber Ca to supply the ink to the pressure chamber Ca. The discharge channel Ra2 communicates with the pressure chamber Cb to discharge the ink from the pressure chamber Cb. The supply channel Ra1 and the discharge channel Ra2 enable a reduction in ink staying in the channel between the supply channel Ra1 and the discharge channel Ra2. Thus, it is possible to suppress an increase in viscosity and precipitation of components of the ink near the nozzle N. As a result, it is possible to prevent a deterioration in ejection characteristics such as the ejection amount or ejection velocity of the ink in the liquid ejecting head 24.

Here, supply of the ink from the supply channel Ra1 to the pressure chamber Ca and discharge of the ink from the pressure chamber Cb to the discharge channel Ra2 are performed by the operation of the circulation mechanism 26. Note that, in the aforementioned coupling form of the circulation mechanism 26 and the liquid ejecting head 24, the supplying side and the discharging side may be reversed. In this case, the supply channel Ra1 functions as a discharge channel through which the ink is discharged from the pressure chamber Ca, and the discharge channel Ra2 functions as a supply channel through which the ink is supplied to the pressure chamber Cb.

As described above, the first branch channel B1 has the second channel B1*b* as a portion extending in the Z-axis direction. Here, the area of the second channel B1*b* as viewed in the Z-axis direction is desirably equal to the area of the first communication channel Na1 as viewed in the Z-axis direction. When the areas are equal to each other, the channel resistance of the first communication channel Na1 is able to be equal to channel resistance of the first branch channel B1. As a result, the ink is able to flow smoothly in each of the first communication channel Na1 and the first branch channel B1 compared with the configuration in which the channel resistances differ from each other. Note that the term "equal" herein includes not only a case of being strictly equal but also a case of being equal with a difference in a range of manufacturing error or the like.

As described above, the liquid ejecting head 24 further includes the plurality of piezoelectric elements 41 and the drive circuit 45. Here, of the plurality of piezoelectric elements 41, a piezoelectric element 41 that, upon application of a driving voltage, generates energy for applying the pressure to the ink of the pressure chamber Ca is an example of the first energy-generating element, and a piezoelectric element 41 that, upon application of a driving voltage, generates energy for applying the pressure to the ink of the pressure chamber Cb is an example of the second energy-generating element. The drive circuit 45 applies a driving voltage to both the piezoelectric elements 41. Therefore, it is possible to simplify the configuration of the liquid ejecting head 24 compared with the configuration in which separate drive circuits are used for the piezoelectric element 41 for the pressure chamber Ca and the piezoelectric element 41 for the pressure chamber Cb.

Here, the drive circuit 45 is positioned between the piezoelectric element 41 for the pressure chamber Ca and the piezoelectric element 41 for the pressure chamber Cb in the X-axis direction. Therefore, compared with the configuration in which the drive circuit 45 is at a different position, supply paths of the driving voltage from the drive circuit 45 to both the piezoelectric elements 41 are able to be shortened. Moreover, according to the present configuration, the dimension of the nozzle channel Nf in the X-axis direction is elongated to ensure a space in which the drive circuit 45 is disposed. Thus, when such a configuration is adopted, it is particularly effective to reduce the channel resistance of the channel extending from the pressure chamber Ca to the nozzle channel Nf and the channel resistance of the channel extending from the pressure chamber Cb to the nozzle channel Nf.

As described above, the aforementioned liquid ejecting apparatus 100 includes the liquid ejecting head 24 and the control unit 21 that is an example of the control section. The control unit 21 controls the ink ejection operation of the liquid ejecting head 24. According to the aforementioned liquid ejecting apparatus 100, the liquid ejecting head 24 has excellent ejection characteristics as described above, image quality is able to be improved.

B: Second Embodiment

A second embodiment of the disclosure will be described below. In an aspect exemplified below, an element having an effect and a function that are similar to those of the first embodiment will be given a reference numeral used in the description of the first embodiment, and detailed description thereof will be omitted as appropriate.

Figure 5:
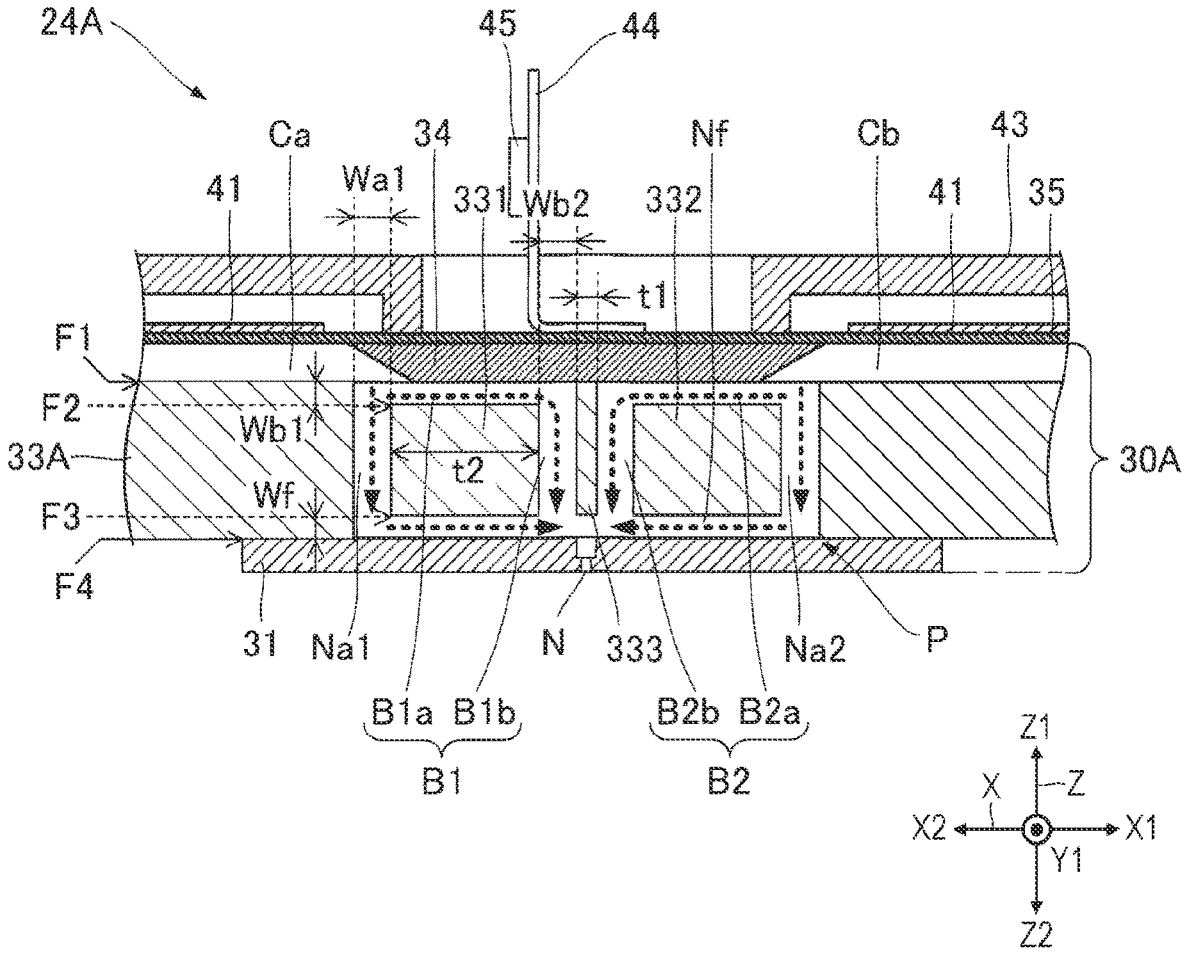
FIG. 5 is an enlarged sectional view illustrating a portion of a liquid ejecting head according to a second embodiment.

FIG. 5 is an enlarged sectional view illustrating a portion of a liquid ejecting head 24A according to the second embodiment. The liquid ejecting head 24A is similar to the liquid ejecting head 24 of the first embodiment described above except that a channel structure 30A is provided instead of the channel structure 30. The channel structure 30A is similar to the channel structure 30 except that a communication plate 33A is provided instead of the communication plate 33. The communication plate 33A is similar to the communication plate 33 except that a partition wall 333 is provided. Note that, in the following description, the matter regarding the first branch channel B1 will be representatively described, and the matter regarding the second branch channel B2 is similar to that of the first branch channel B1, and thus description thereof will be omitted as appropriate.

The partition wall 333 is a member that separates the first branch channel B1 and the second branch channel B2. In the example illustrated in FIG. 5, the partition wall 333 extends from the pressure chamber substrate 34 in direction Z2. A gap that is approximately equal to width Wf of the nozzle channel Nf in the Z-axis direction is formed between the partition wall 333 and the nozzle substrate 31.

As described above, the liquid ejecting head 24A of the present embodiment includes the partition wall 333 as an example of a first partition wall and the partition wall 331 as an example of a second partition wall. The partition wall 333 separates the first branch channel B1 and the second branch channel B2. The partition wall 331 separates the first communication channel Na1 and the first branch channel B1.

Here, thickness t1 of the partition wall 333 in the X-axis direction is smaller than thickness t2 of the partition wall 331 in the X-axis direction. Therefore, a distance between a communication position of the first branch channel B1 and the nozzle channel Nf and a communication position of the second branch channel B2 and the nozzle channel Nf is able to be shortened compared with the configuration in which thickness t1 of the partition wall 333 is greater than thickness t2 of the partition wall 331. As a result, the respective communication positions are able to be close to the nozzle N. Moreover, compared with the configuration in which no partition wall 333 is provided, in the configuration in which the partition wall 333 is provided, the amount of the ink flowing between the first branch channel B1 and the second branch channel B2 is reduced, thus making it possible to reduce a pressure loss due to a turbulent flow or the like between the channels.

From the viewpoint of making the dimension of the channel extending from the pressure chamber Ca to the nozzle N as short as possible, thickness t1 of the partition wall 333 in the X-axis direction is desirably smaller than width Wal of the first communication channel Na1 in the X-axis direction. Note that thickness t1 is fixed in the example illustrated in FIG. 5, but thickness t1 may be unfixed.

Moreover, similarly to the first embodiment described above, the first branch channel B1 has the second channel B1*b* as a portion extending in the Z-axis direction. Here, the area of the second channel B1*b* as viewed in the Z-axis direction is desirably equal to the area of the first communication channel Na1 as viewed in the Z-axis direction. When the areas are equal to each other, the channel resistance of the first communication channel Na1 is able to be equal to the channel resistance of the first branch channel B1. As a result, the ink is able to flow smoothly in each of the first communication channel Na1 and the first branch channel B1 compared with the configuration in which the channel resistances differ from each other.

The second embodiment described above also enables efficient transfer of the pressure from the pressure chamber Ca to the nozzle N while achieving desired ejection characteristics.

Moreover, in the second embodiment, the ink passing through the first branch channel B1 always passes through immediately above the nozzle N. Thus, the amount of the ink passing through immediately above the nozzle N increases compared with the first embodiment. As a result, it is possible to further suppress an increase in viscosity near the nozzle N due to, for example, the ink being evaporated from the nozzle N.

C: Third Embodiment

A third embodiment of the disclosure will be described below. In an aspect exemplified below, an element having an effect and a function that are similar to those of the first embodiment will be given a reference numeral used in the description of the first embodiment, and detailed description thereof will be omitted as appropriate.

Figure 6:
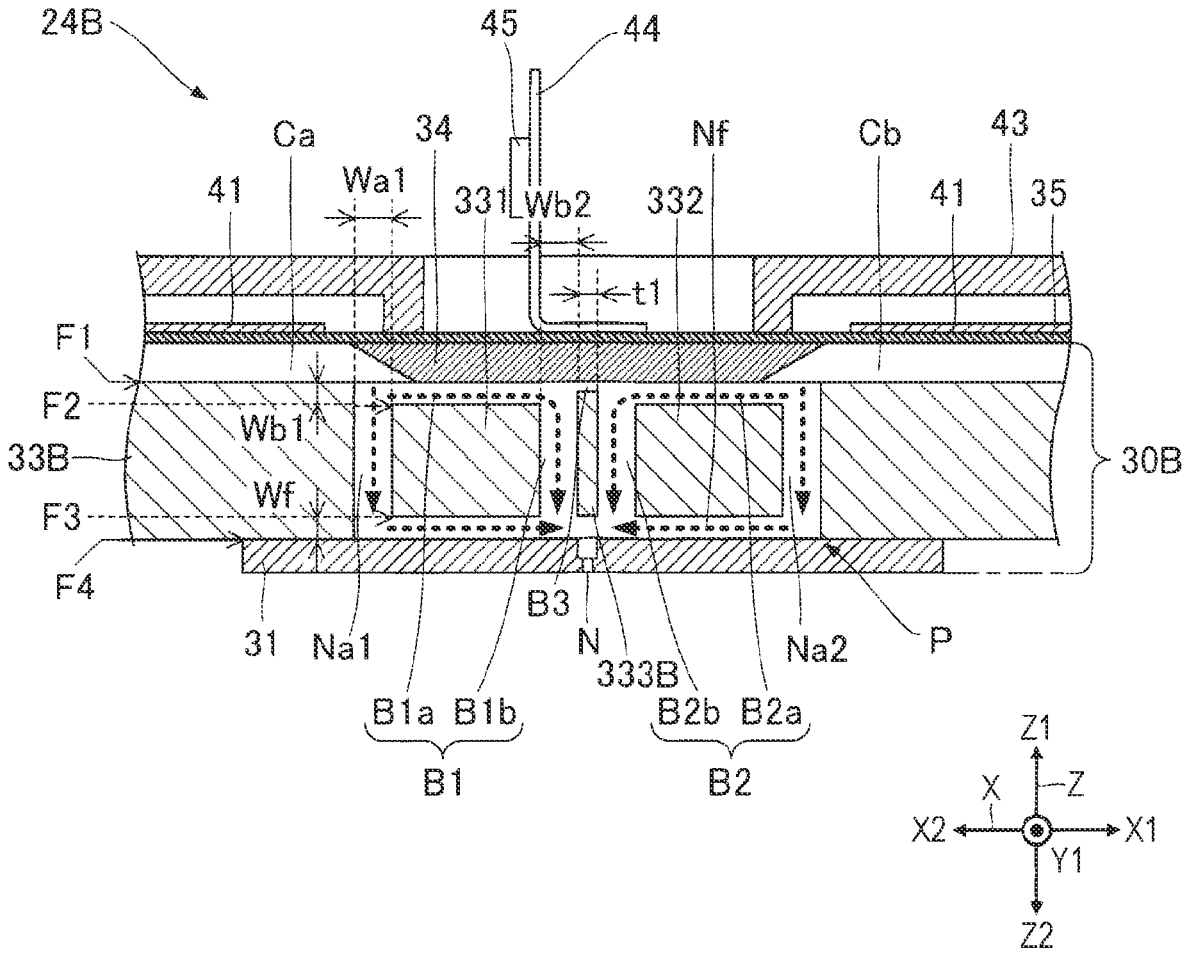
FIG. 6 is an enlarged sectional view illustrating a portion of a liquid ejecting head according to a third embodiment.

FIG. 6 is an enlarged sectional view illustrating a portion of a liquid ejecting head 24B according to the third embodiment. The liquid ejecting head 24B is similar to the liquid ejecting head 24 of the first embodiment described above except that a channel structure 30B is provided instead of the channel structure 30. The channel structure 30B is similar to the channel structure 30 except that a communication plate 33B is provided instead of the communication plate 33. The communication plate 33B is similar to the communication plate 33A of the second embodiment described above except that a partition wall 333B is provided instead of the partition wall 333. Note that, in the following description, the matter regarding the first branch channel B1 will be representatively described, and the matter regarding the second branch channel B2 is similar to that of the first branch channel B1, and thus description thereof will be omitted as appropriate.

The partition wall 333B is similar to the partition wall 333 of the second embodiment described above except that a third communication channel B3 is provided. The third communication channel B3 is a channel passing through the partition wall 333B and enables the first branch channel B1 and the second branch channel B2 to communicate with each other. In the example illustrated in FIG. 6, the third communication channel B3 is formed by a groove provided on the surface facing direction Z1 of the partition wall 333B. Note that the third communication channel B3 may be formed by a through hole penetrating through the partition wall 333B.

As described above, the liquid ejecting head 24B further includes the third communication channel B3 that enables the first branch channel B1 and the second branch channel B2 to communicate with each other through a path different from a path of the nozzle channel Nf. Therefore, air bubbles are able to flow from one of the first branch channel B1 and the second branch channel B2 to the other channel via the third communication channel B3. As a result, it is possible to reduce air bubbles staying in the first branch channel B1 and the second branch channel B2. Note that the flow of air bubbles through the third communication channel B3 is performed upon mainly the operation of the circulation mechanism 26 described above.

Here, from the viewpoint of efficiently transferring pressure from the first channel B1*a* to the second channel B1*b*, the third communication channel B3 width in the Z-axis direction is narrower than width Wbi of the first channel B1*a*.

The third embodiment described above also enables efficient transfer of pressure from the pressure chamber Ca to the nozzle N while achieving desired ejection characteristics.

R: Fourth Embodiment

A fourth embodiment of the disclosure will be described below. In an aspect exemplified below, an element having an effect and a function that are similar to those of the first embodiment will be given a reference numeral used in the description of the first embodiment, and detailed description thereof will be omitted as appropriate.

Figure 7:
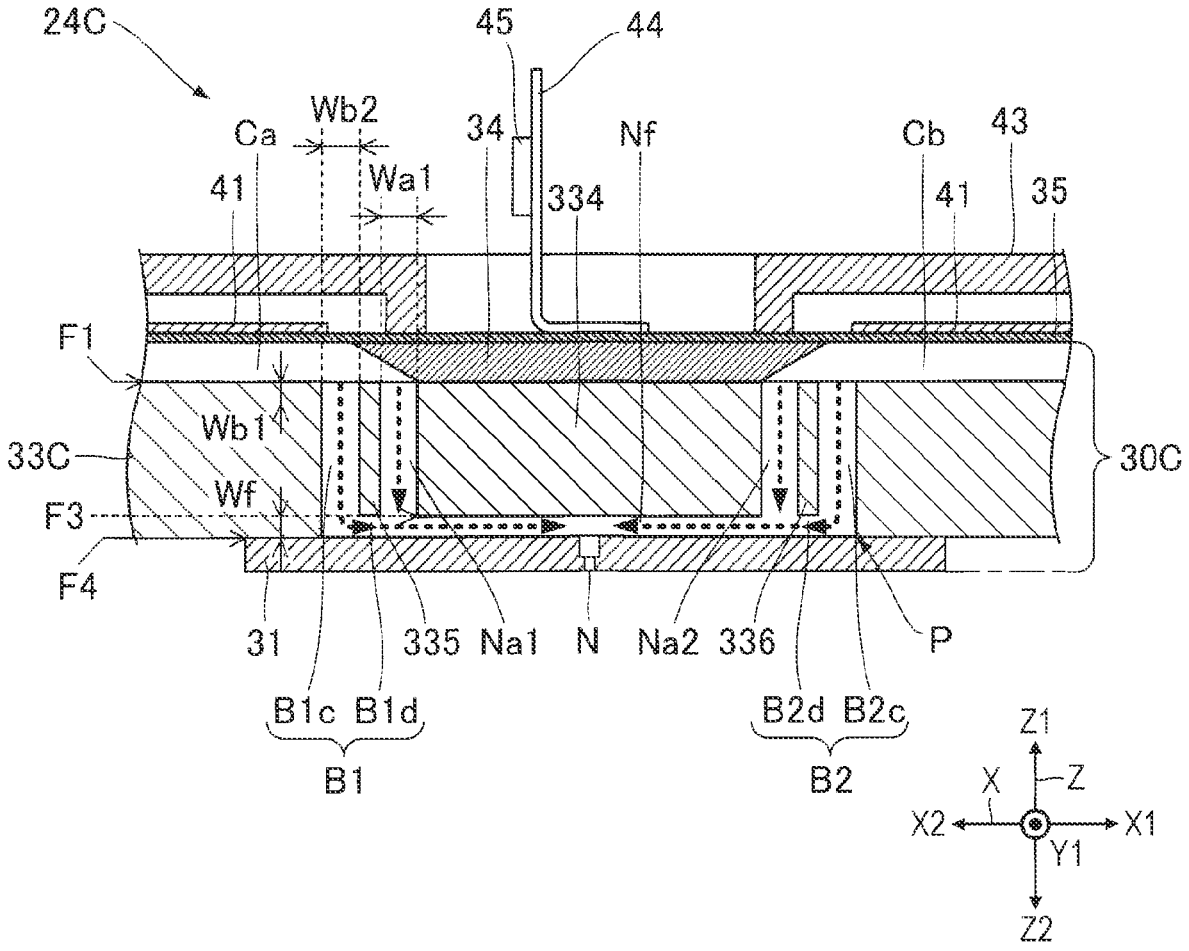
FIG. 7 is an enlarged sectional view illustrating a portion of a liquid ejecting head according to a fourth embodiment.

FIG. 7 is an enlarged sectional view illustrating a portion of a liquid ejecting head 24C according to the fourth embodiment. The liquid ejecting head 24C is similar to the liquid ejecting head 24 of the first embodiment described above except that a channel structure 30C is provided instead of the channel structure 30. The channel structure 30C is similar to the channel structure 30 except that a communication plate 33C is provided instead of the communication plate 33. The communication plate 33C is similar to the communication plate 33 except for a difference in the configuration of the first branch channel B1 and the second branch channel B2. Note that, in the following description, the matter regarding the first branch channel B1 will be representatively described, and the matter regarding the second branch channel B2 is similar to that of the first branch channel B1, and thus description thereof will be omitted as appropriate.

The first branch channel B1 of the present embodiment has a portion extending from the pressure chamber Ca in direction Z2, and a partition wall 335 separates the first branch channel B1 and the first communication channel Na1. The first branch channel B1 of the present embodiment has a first channel B1*c* extending in the Z-axis direction and a second channel B1*d* extending in the X-axis direction.

Similarly, the second branch channel B2 of the present embodiment has a portion extending from the pressure chamber Cb in direction Z2, and a partition wall 336 separates the second branch channel B2 and the second communication channel Na2. The second branch channel B2 of the present embodiment has a third channel B2*c* extending in the Z-axis direction and a fourth channel B2*d* extending in the X-axis direction.

Here, the first branch channel B1 and the second branch channel B2 are similar in the configuration except that they are configured symmetrically in the X-axis direction. Thus, the first channel B1*c* and the third channel B2*c* are configured symmetrically in the X-axis direction. Moreover, the second channel B1*d* and the fourth channel B2*d* are configured symmetrically in the X-axis direction.

The first branch channel B1 will be representatively described below, and description for the second branch channel B2 will be omitted as appropriate. Note that the first branch channel B1 and the second branch channel B2 may be configured asymmetrically in the X-axis direction.

The first channel B1*c* is a space formed by a hole penetrating through the communication plate 33C in the Z-axis direction. An end of the aforementioned first channel B1*c* in direction Z1 communicates with the pressure chamber Ca. On the other hand, an end of the first channel B1*c* in direction Z2 communicates with the second channel B1*d*.

The second channel B1*d* is a space formed by a groove provided on the surface facing direction Z2 of the communication plate 33C. An end of the second channel B1*d* in direction X2 communicates with the first channel B1*c*. On the other hand, an end of the second channel B1*d* in direction X1 communicates with the nozzle channel Nf. Here, the second channel B1*d* is formed by extending the nozzle channel Nf, and it may be said that the second channel B1*d* constitutes a portion of the nozzle channel Nf.

The fourth embodiment described above also enables efficient transfer of pressure from the pressure chamber Ca to the nozzle N while achieving desired ejection characteristics. According to the present embodiment, it is also possible to shorten dimensions of the portions extending in the X-axis direction of the first branch channel B1 and the second branch channel B2. Thus, there is an advantage that channel resistances of the channels are easily reduced.

E: Reference Example

A reference example will be described below. In an aspect exemplified below, an element having an effect and a function that are similar to those of the first embodiment will be given a reference numeral used in the description of the first embodiment, and detailed description thereof will be omitted as appropriate.

E1: Channels of Liquid Ejecting Head

Figure 8:
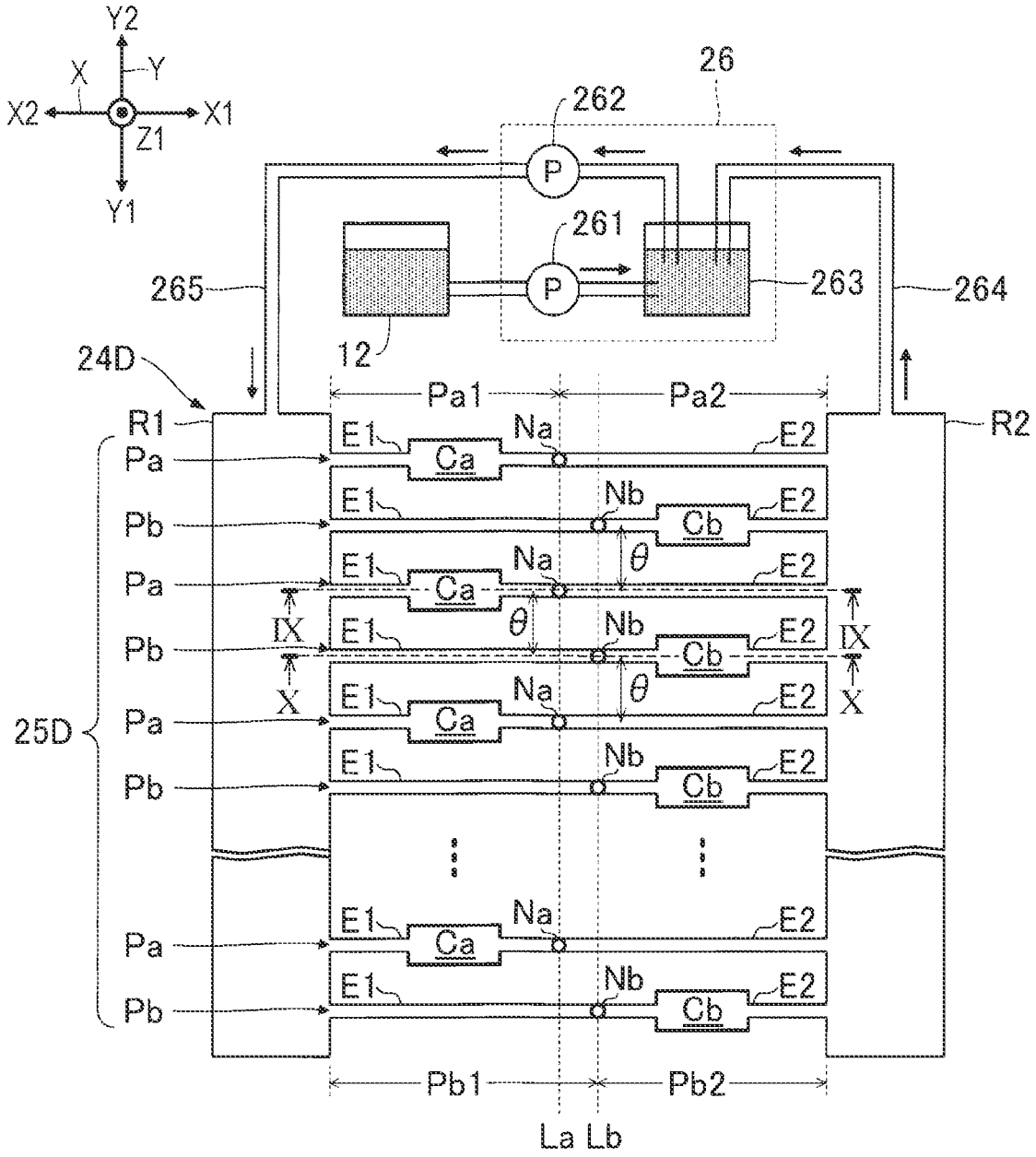
FIG. 8 is a schematic view of channels of a liquid ejecting head according to a reference example.

FIG. 8 is a schematic view of channels of a liquid ejecting head 24D according to the reference example. The liquid ejecting head 24D is similar to the liquid ejecting head 24 of the first embodiment described above except that a plurality of individual channels Pa and a plurality of individual channels Pb are provided instead of the plurality of individual channels P. That is, as illustrated in FIG. 8, the liquid ejecting head 24D includes the plurality of nozzles N, the plurality of individual channels Pa, the plurality of individual channels Pb, the first common liquid chamber R1, and the second common liquid chamber R2, and the circulation mechanism 26 is coupled to the liquid ejecting head 24.

Specifically, the liquid ejecting head 24D has a surface facing the medium 11, and a plurality of nozzles Na and a plurality of nozzles Nb are provided on the surface as illustrated in FIG. 8. The nozzles are similar to the nozzles N in the first embodiment described above in the configuration and eject the ink in direction Z2. Note that, in the following description, when there is no particular necessity to distinguish between the nozzles Na and the nozzles Nb, they are simply referred to also as "nozzles N".

The plurality of nozzles Na are arrayed in the Y-axis direction and a set of them constitutes a first nozzle row La. Similarly, the plurality of nozzles Nb are arrayed in the Y-axis direction, and a set of them constitutes a second nozzle row Lb.

The first nozzle row La and the second nozzle row Lb are arranged side by side with a given gap therebetween in the X-axis direction. Here, although a pitch at which the nozzles Na are arrayed and a pitch at which the nozzles Nb are arrayed are equal to each other, a nozzle Na and a nozzle Nb that are closest to each other are arranged so as to be shifted from each other at the aforementioned pitch θ in the Y-axis direction.

Each of the plurality of nozzles Na communicates with a corresponding one of the individual channels Pa. The plurality of individual channels Pa extend in the X-axis direction and communicate with different nozzles Na. Similarly, each of the plurality of nozzles Nb communicates with a corresponding one of the individual channels Pb. The plurality of individual channels Pb extend in the X-axis direction and communicate with different nozzles Nb. The individual channel Pa and the individual channel Pb are alternately arrayed in the Y-axis direction, and a set of the plurality of individual channels Pa and the plurality of individual channels Pb constitutes an individual channel row 25D.

The individual channel Pa is similar to the individual channel P of the first embodiment described above except that the pressure chamber Cb is omitted. Specifically, the individual channel Pa includes a first portion Pa1 and a second portion Pa2. The first portion Pal of the individual channel Pa is a channel between the upstream end E1 of the individual channel Pa and the nozzle Na. The first portion Pa1 includes the pressure chamber Ca. On the other hand, the second portion Pa2 of the individual channel Pa is a channel between the downstream end E2 of the individual channel Pa and the nozzle Na.

The individual channel Pb is similar to the individual channel P of the first embodiment described above except that the pressure chamber Ca is omitted. Specifically, the individual channel Pb includes a third portion Pb1 and a fourth portion Pb2. The third portion Pb1 of the individual channel Pb is a channel between the upstream end E1 of the individual channel Pb and the nozzle Nb. On the other hand, the fourth portion Pb2 of the individual channel Pb is a channel between the downstream end E2 of the individual channel Pb and the nozzle Nb. The fourth portion Pb2 includes the pressure chamber Cb.

The upstream end E1 of each of the individual channels Pa and the upstream end E1 of each of the individual channels Pb are coupled to the first common liquid chamber R1. On the other hand, the downstream end E2 of each of the individual channels Pa and the downstream end E2 of each of the individual channels Pb are coupled to the second common liquid chamber R2.

E2: Specific Structure of Liquid Ejecting Head

Figure 9:
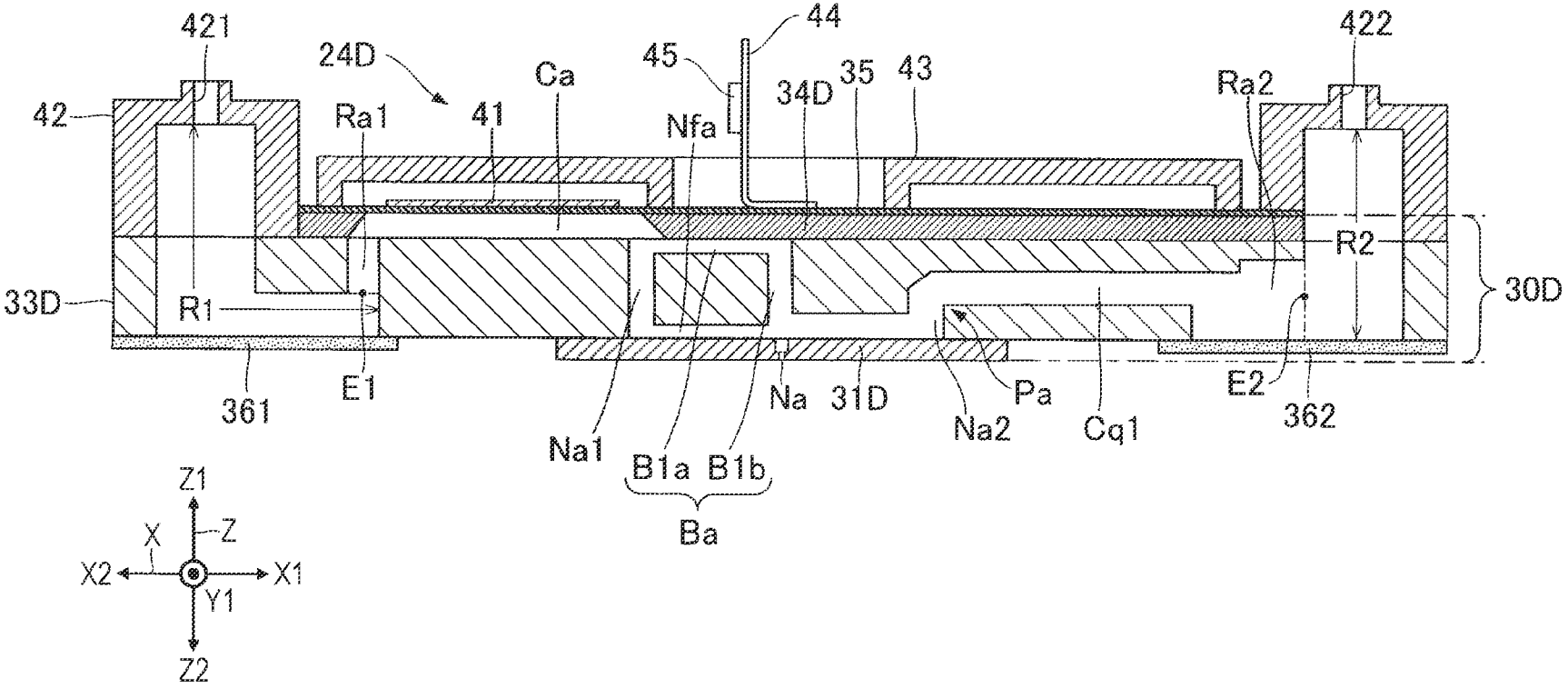
FIG. 9 is a sectional view along line IX-IX in FIG. 8.
Figure 10:
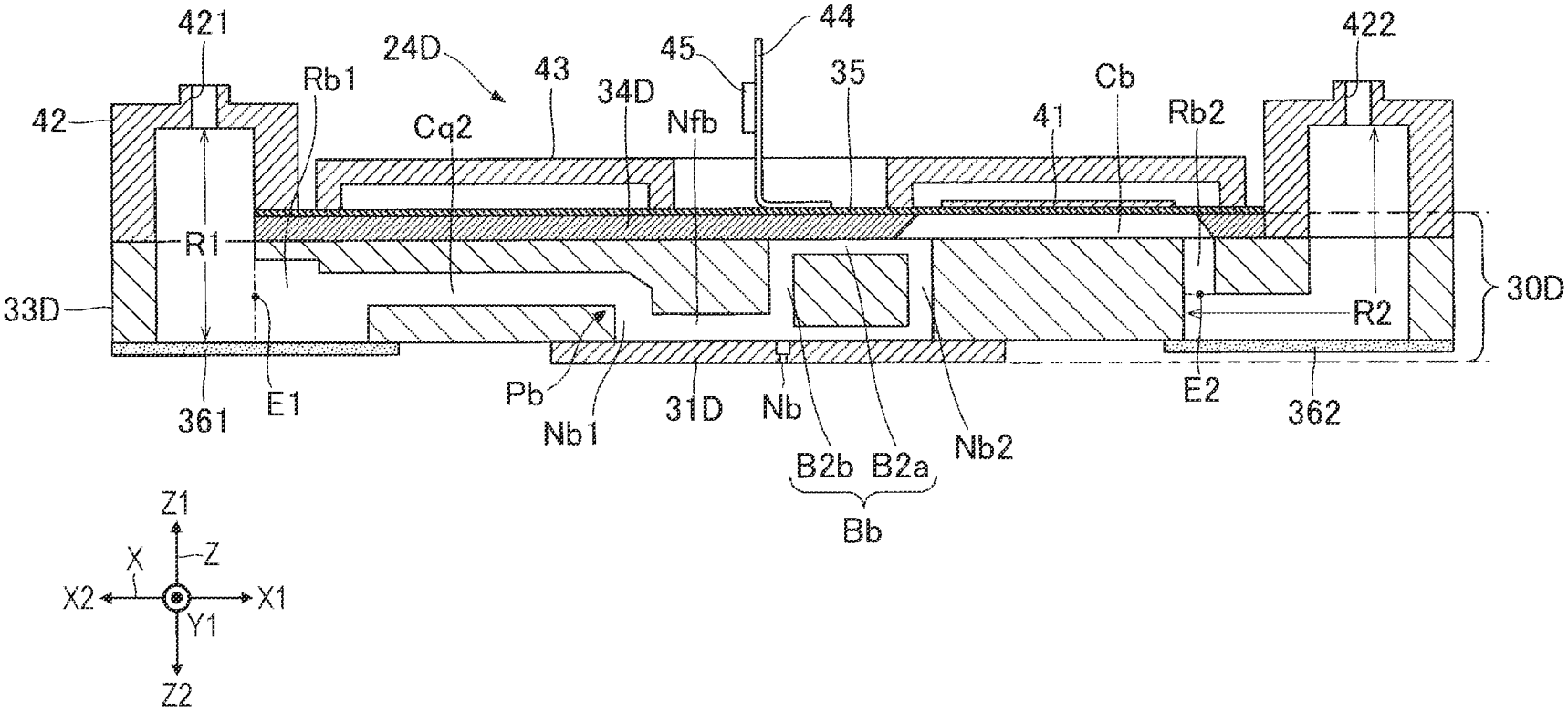
FIG. 10 is a sectional view along line X-X in FIG. 8.

FIG. 9 is a sectional view along line IX-IX in FIG. 8. FIG. 9 illustrates a sectional surface of the liquid ejecting head 24D, which is taken along a plane parallel to the X-axis and the Z-axis of the individual channel Pa. FIG. 10 is a sectional view along line X-X in FIG. 8. FIG. 10 illustrates a sectional surface of the liquid ejecting head 24D, which is taken along a plane parallel to the X-axis and the Z-axis of the individual channel Pb.

As illustrated in FIGS. 9 and 10, the liquid ejecting head 24D is similar to the liquid ejecting head 24 of the first embodiment described above except that a lateral communication channel Cq1 is provided instead of a portion of the pressure chamber Ca and that a lateral communication channel Cq2 is provided instead of a portion of the pressure chamber Cb.

As illustrated in FIGS. 9 and 10, the liquid ejecting head 24D includes a channel structure 30D, the plurality of piezoelectric elements 41, the housing 42, the protection substrate 43, and the wiring substrate 44.

The channel structure 30D includes the first common liquid chamber R1, the second common liquid chamber R2, the plurality of individual channels Pa, the plurality of individual channels Pb, and the plurality of nozzles N described above. Specifically, the channel structure 30D is similar to the channel structure 30 of the first embodiment described above except that a nozzle substrate 31D, a communication plate 33D, and a pressure chamber substrate 34D are provided instead of the nozzle substrate 31, the communication plate 33, and the pressure chamber substrate 34.

The nozzle substrate 31D is provided with the plurality of nozzles Na and the plurality of nozzles Nb. Here, the nozzle substrate 31D is similar to the nozzle substrate 31 described above in the configuration except for a difference in arrangement of the nozzles Na and the nozzles Nb.

In the communication plate 33D, a portion of the first common liquid chamber R1, a portion of the second common liquid chamber R2, a portion other than the pressure chamber Ca in each of the plurality of individual channels Pa, and a portion other than the pressure chamber Cb in each of the plurality of individual channels Pb are provided.

As illustrated in FIG. 9, each of the individual channels Pa has, in addition to the pressure chamber Ca described above, a nozzle channel Nfa, the lateral communication channel Cq1, the first communication channel Na1, the second communication channel Na2, a branch channel Ba, the supply channel Ra1, and the discharge channel Ra2. Among these, the nozzle channel Nfa, the lateral communication channel Cq1, the first communication channel Na1, the second communication channel Na2, the branch channel Ba, the supply channel Ra1, and the discharge channel Ra2 are provided in the communication plate 33D.

The nozzle channel Nfa is a space in a groove provided on the surface facing direction Z2 of the communication plate 33D. Here, the nozzle substrate 31D constitutes a portion of a wall surface of the nozzle channel Nfa. The nozzle channel Nfa is provided with the nozzle Na.

The first communication channel Na1 enables the pressure chamber Ca and the nozzle channel Nfa to communicate with each other and guides the ink from the pressure chamber Ca to the nozzle channel Nfa. On the other hand, the second communication channel Na2 enables the lateral communication channel Cq1 and the nozzle channel Nfa to communicate with each other and guides the ink from the nozzle channel Nfa to the lateral communication channel Cq1.

The branch channel Ba enables the pressure chamber Ca and the nozzle channel Nfa to communicate with each other through a path different from a path of the first communication channel Na1 and guides the ink from the pressure chamber Ca to the nozzle channel Nfa. Similarly to the first branch channel B1 of the first embodiment described above, the branch channel Ba has the first channel B1*a* extending in the X-axis direction and the second channel B1*b* extending in the Z-axis direction.

The lateral communication channel Cq1 is a space extending in the X-axis direction. The lateral communication channel Cq1 enables the second communication channel Na2 and the discharge channel Ra2 to communicate with each other and guides the ink from the second communication channel Na2 to the discharge channel Ra2.

The supply channel Ra1 enables the first common liquid chamber R1 and the pressure chamber Ca to communicate with each other and is used to supply the ink from the first common liquid chamber R1 to the pressure chamber Ca. On the other hand, the discharge channel Ra2 enables the second common liquid chamber R2 and the lateral communication channel Cq1 to communicate with each other and is used to discharge the ink from the lateral communication channel Cq1 to the second common liquid chamber R2.

On the other hand, each of the individual channels Pb and each of the individual channels Pa described above are symmetrically configured in the X-axis direction. Specifically, as illustrated in FIG. 10, each of the individual channels Pb has, in addition to the pressure chamber Cb described above, a nozzle channel Nfb, the lateral communication channel Cq2, a third communication channel Nb1, a fourth communication channel Nb2, a branch channel Bb, a supply channel Rb1, and a discharge channel Rb2. Among these, the nozzle channel Nfb, the lateral communication channel Cq2, the third communication channel Nb1, the fourth communication channel Nb2, the branch channel Bb, the supply channel Rb1, and the discharge channel Rb2 are provided in the communication plate 33D.

The nozzle channel Nfb is a space in a groove provided on the surface facing direction Z2 of the communication plate 33D. Here, the nozzle substrate 31D constitutes a portion of a wall surface of the nozzle channel Nfb. The nozzle channel Nfb is provided with the nozzle Nb.

The third communication channel Nb1 enables the lateral communication channel Cq2 and the nozzle channel Nfb to communicate with each other and guides the ink from the lateral communication channel Cq2 to the nozzle channel Nfb. On the other hand, the fourth communication channel Nb2 enables the pressure chamber Cb and the nozzle channel Nfb to communicate with each other and guides the ink from the nozzle channel Nfb to the pressure chamber Cb.

The branch channel Bb enables the pressure chamber Cb and the nozzle channel Nfb to communicate with each other through a path different from a path of the fourth communication channel Nb2 and guides the ink from the pressure chamber Cb to the nozzle channel Nfb. Similarly to the second branch channel B2 of the first embodiment described above, the branch channel Bb has the third channel B2*a* extending in the X-axis direction and the fourth channel B2*b* extending in the Z-axis direction.

The lateral communication channel Cq2 enables the supply channel Rb1 and the third communication channel Nb1 to communicate with each other and guides the ink from the supply channel Rb1 to the third communication channel Nb1.

The supply channel Rb1 enables the first common liquid chamber R1 and the lateral communication channel Cq2 to communicate with each other and is used to supply the ink from the first common liquid chamber R1 to the lateral communication channel Cq2. On the other hand, the discharge channel Rb2 enables the second common liquid chamber R2 and the pressure chamber Cb to communicate with each other and is used to discharge the ink from the pressure chamber Cb to the second common liquid chamber R2.

The pressure chamber substrate 34D is similar to the pressure chamber substrate 34 of the first embodiment described above except for a difference in arrangement of the pressure chamber Ca and the pressure chamber Cb. Specifically, as illustrated in FIGS. 9 and 10, the pressure chambers Ca in the plurality of individual channels Pa and the pressure chambers Cb in the plurality of individual channels Pb are provided in the pressure chamber substrate 34D. Note that the plurality of piezoelectric elements 41 are arranged so as to correspond to arrangement of the plurality of pressure chambers Ca and the plurality of pressure chambers Cb provided in the pressure chamber substrate 34D.

The foregoing reference example is also able to achieve an effect similar to that of the first embodiment described above. In the liquid ejecting head 24D of the present reference example, a channel of an individual channel Pb overlaps neither a pressure chamber Ca nor a lateral communication channel of an individual channel Pa that is adjacent to the individual channel Pb. Similarly, a channel of an individual channel Pa overlaps neither a pressure chamber Cb nor a lateral communication channel Cq2 of an individual channel Pb that is adjacent to the individual channel Pa as viewed in the Y-axis direction. Therefore, even when the pitch θ is reduced, crosstalk between the individual channel Pa and the individual channel Pb that are adjacent to each other is difficult to be caused compared with the embodiments described above. As a result, by increasing nozzle resolution in the Z-axis direction with a reduction in the pitch θ, image quality is able to be improved.

F: Modified Examples

Each of the aspects exemplified above can be variously modified. Specific aspects of the modifications that can be applied to each of the aspects described above will be exemplified below. Any aspects selected from the following examples can be combined with each other within the scope in which they do not conflict.

Modified Example 1

Although each of the aspects described above exemplifies the configuration in which the nozzle channel, the first communication channel, and the second communication channel are each formed so as to linearly extend with a certain width, the configuration of the disclosure is not limited thereto. For example, each of the channels may have a portion that is bent or curved in the middle of the channel or may have a plurality of portions that differ in width. Similarly, the first channel or the second channel in the first branch channel may have a portion that is bent or curved in the middle of the channel or may have a plurality of portions that differ in width. Moreover, the third channel or the fourth channel in the second branch channel may have a portion that is bent or curved in the middle of the channel or may have a plurality of portions that differ in width.

Modified Example 2

Although each of the aspects described above exemplifies the configuration in which the ink used for the liquid ejecting head is circulated by the circulation mechanism, the configuration of the disclosure is not limited thereto and may be a configuration in which such a mechanism for circulation is not provided.

Modified Example 3

The energy-generating element that changes the pressure of the ink in the pressure chamber C is not limited to the piezoelectric element 41 exemplified in each of the aspects described above. For example, a heating element that generates air bubbles in the pressure chamber C by heating and thereby changes the pressure of the ink may be used as the energy-generating element.

Modified Example 4

Although each of the aspects described above exemplifies the liquid ejecting apparatus 100 of a serial type in which the transport body 231 on which the liquid ejecting head 24 is mounted is reciprocated, the disclosure is applicable to a liquid ejecting apparatus of a line type in which a plurality of nozzles N are distributed over the entire width of the medium 11.

The liquid ejecting apparatus 100 exemplified in the aspects described above may be adopted for various apparatuses such as a facsimile apparatus and a copying machine in addition to equipment dedicated to printing, and the use of the disclosure is not particularly limited. Needless to say, the liquid ejecting apparatus is not limited to being used for printing. For example, a liquid ejecting apparatus that ejects a solution of a color material is used as a manufacturing apparatus that forms a color filter of a display apparatus such as a liquid crystal display panel. Further, a liquid ejecting apparatus that ejects a solution of a conductive material is used as a manufacturing apparatus that forms a wire and an electrode of a wiring substrate. In addition, a liquid ejecting apparatus that ejects an organic solution regarding a living body is used as a manufacturing apparatus that manufactures a biochip, for example.

What is claimed is:

1. A liquid ejecting head comprising:

a first pressure chamber that applies pressure to a liquid;

a second pressure chamber that applies pressure to the liquid;

a nozzle channel that extends in a first direction and communicates with a nozzle that ejects the liquid;

a first communication channel that extends in a second direction crossing the first direction and enables the first pressure chamber and the nozzle channel to communicate with each other;

a second communication channel that extends in the second direction and enables the second pressure chamber and the nozzle channel to communicate with each other; and a first branch channel that has a portion extending in the first direction and enables the first pressure chamber and the nozzle channel to communicate with each other through a path different from a path of the first communication channel, wherein the first pressure chamber, the second pressure chamber, the nozzle channel, the first communication channel, the second communication channel, and the first branch channel form an individual channel which is individually provided with the nozzle, and wherein the first branch channel communicates with the nozzle channel at a position closer than the first communication channel to the nozzle.

2. The liquid ejecting head according to claim 1, wherein the first branch channel includes:

a first channel that extends in the first direction and communicates with the first pressure chamber; and a second channel that extends in the second direction and enables the first channel and the nozzle channel to communicate with each other.

3. The liquid ejecting head according to claim 1, wherein the first pressure chamber and the nozzle channel extend in the first direction, and the first communication channel enables an end of the first pressure chamber on one side in the first direction and an end of the nozzle channel on another side in the first direction to communicate with each other.

4. The liquid ejecting head according to claim 1, further comprising a second branch channel that has a portion extending in the first direction and enables the second pressure chamber and the nozzle channel to communicate with each other through a path different from a path of the second communication channel.

5. The liquid ejecting head according to claim 4, further comprising a third communication channel that enables the first branch channel and the second branch channel to communicate with each other through a path different from a path of the nozzle channel.

6. The liquid ejecting head according to claim 4, further comprising:

a first partition wall that separates the first branch channel and the second branch channel; and a second partition wall that separates the first communication channel and the first branch channel, wherein a thickness of the first partition wall in the first direction is smaller than a thickness of the second partition wall in the first direction.

7. The liquid ejecting head according to claim 4, wherein the first branch channel and the second branch channel have a shared portion extending in the second direction.

8. The liquid ejecting head according to claim 1, further comprising:

a supply channel which communicates with the first pressure chamber and through which the liquid is supplied to the first pressure chamber; and a discharge channel which communicates with the second pressure chamber and through which the liquid is discharged from the second pressure chamber.

9. The liquid ejecting head according to claim 1, further comprising:

a supply channel which communicates with the second pressure chamber and through which the liquid is supplied to the second pressure chamber; and a discharge channel which communicates with the first pressure chamber and through which the liquid is discharged from the first pressure chamber.

10. The liquid ejecting head according to claim 1, wherein the first branch channel includes a second channel that extends in the second direction and that communicates with the nozzle channel, and an area of the second channel as viewed in the second direction is equal to an area of the first communication channel as viewed in the second direction.

11. The liquid ejecting head according to claim 1, further comprising:

a first energy-generating element that, upon application of a driving voltage, generates energy for applying pressure to the liquid in the first pressure chamber;

a second energy-generating element that, upon application of a driving voltage, generates energy for applying pressure to the liquid in the second pressure chamber; and a drive circuit that applies a driving voltage to both the first energy-generating element and the second energy-generating element.

12. The liquid ejecting head according to claim 11, wherein the drive circuit is positioned, as viewed in the second direction, between the first energy-generating element and the second energy-generating element in the first direction.

13. A liquid ejecting apparatus comprising:

the liquid ejecting head according to claim 1; and a control section that controls liquid ejection operation of the liquid ejecting head.

14. A liquid ejecting head comprising:

a first pressure chamber that applies pressure to a liquid;

a second pressure chamber that applies pressure to the liquid;

a nozzle channel that extends in a first direction and communicates with a nozzle that ejects the liquid;

a first communication channel that extends in a second direction crossing the first direction and enables the first pressure chamber and the nozzle channel to communicate with each other;

a second communication channel that extends in the second direction and enables the second pressure chamber and the nozzle channel to communicate with each other;

a first branch channel that has a portion extending in the first direction and enables the first pressure chamber and the nozzle channel to communicate with each other through a path different from a path of the first communication channel;

a pressure chamber substrate in which the first pressure chamber and the second pressure chamber are provided;

a communication plate in which the nozzle channel, the first communication channel, the second communication channel, and the first branch channel are provided; and a nozzle substrate in which the nozzle is provided, wherein the first pressure chamber, the second pressure chamber, the nozzle channel, the first communication channel, the second communication channel, and the first branch channel form an individual channel which is individually provided with the nozzle.

15. The liquid ejecting head according to claim 14, wherein wall surfaces of the first branch channel include a first wall surface constituted by the pressure chamber substrate, and a second wall surface positioned opposite to the first wall surface in the second direction and constituted by the communication plate.

16. The liquid ejecting head according to claim 14, wherein wall surfaces of the nozzle channel include a third wall surface constituted by the communication plate, and a fourth wall surface positioned opposite to the third wall surface in the second direction and constituted by the nozzle substrate.

17. A liquid ejecting head comprising:

a first pressure chamber that applies pressure to a liquid;

a second pressure chamber that applies pressure to the liquid;

a nozzle channel that extends in a first direction and includes a nozzle that ejects the liquid;

a first communication channel that extends in a second direction crossing the first direction and enables the first pressure chamber and the nozzle channel to communicate with each other;

a second communication channel that extends in the second direction and enables the second pressure chamber and the nozzle channel to communicate with each other;

a first branch channel that has a portion extending in the first direction and enables the first pressure chamber and the nozzle channel to communicate with each other through a path different from a path of the first communication channel;

a pressure chamber substrate in which the first pressure chamber and the second pressure chamber are provided;

a communication plate in which the nozzle channel, the first communication channel, the second communication channel, and the first branch channel are provided; and a nozzle substrate in which the nozzle is provided, wherein wall surfaces of the first branch channel include a first wall surface constituted by the pressure chamber substrate, and a second wall surface positioned opposite to the first wall surface in the second direction and constituted by the communication plate.

* * * * *